US008803739B2

(12) United States Patent
Rajgopal et al.

(10) Patent No.: US 8,803,739 B2
(45) Date of Patent: Aug. 12, 2014

(54) MULTI-FUNCTIONAL CRLH ANTENNA DEVICE

(75) Inventors: Sunil Kumar Rajgopal, San Diego, CA (US); Ajay Gummalla, Sunnyvale, CA (US); Cheng Jung Lee, Santa Clara, CA (US); Vaneet Pathak, San Diego, CA (US)

(73) Assignee: Tyco Electronics Services GmbH (CH)

( * ) Notice: Subject to any disclaimer, the term of this patent is extended or adjusted under 35 U.S.C. 154(b) by 157 days.

(21) Appl. No.: 13/038,450

(22) Filed: Mar. 2, 2011

(65) Prior Publication Data

US 2011/0267244 A1 Nov. 3, 2011

Related U.S. Application Data

(60) Provisional application No. 61/310,220, filed on Mar. 3, 2010.

(51) Int. Cl.
*H01Q 1/38* (2006.01)
*H01Q 1/24* (2006.01)

(52) U.S. Cl.
USPC ..... 343/700 MS; 343/720

(58) Field of Classification Search
USPC ..... 343/702, 720, 700 MS
See application file for complete search history.

(56) References Cited

U.S. PATENT DOCUMENTS

| | | | | |
|---|---|---|---|---|
| 7,383,067 | B2 * | 6/2008 | Phillips et al. | 455/575.1 |
| 7,388,547 | B2 * | 6/2008 | Lee | 343/702 |
| 7,420,524 | B2 * | 9/2008 | Werner et al. | 343/909 |
| 7,847,739 | B2 * | 12/2010 | Achour et al. | 343/700 MS |
| 2007/0289858 | A1 * | 12/2007 | Choi | 200/5 A |
| 2008/0048917 | A1 * | 2/2008 | Achour et al. | 343/700 MS |

* cited by examiner

*Primary Examiner* — Hoang V Nguyen
*Assistant Examiner* — Patrick Holecek

(57) ABSTRACT

This application relates to a multi-functional Composite Right and Left Handed CRLH antenna device. A conductive element of a wireless device is incorporated into the antenna structure for reuse. In one embodiment a peripheral feature, such as a key dome, is incorporated into the antenna device. In this way, the antenna structure includes portions which are multi-functional.

21 Claims, 16 Drawing Sheets

MULTI-FUNCTIONAL CRLH ANTENNA DEVICE

PRIORITY CLAIMS AND RELATED APPLICATIONS

This application claims the benefit of priority under 35 U.S.C. 119(e) to U.S. Provisional Patent Application Ser. No. 61/310,220, entitled "MULTI-FUNCTIONAL COMPOSITE RIGHT AND LEFT HANDED (CRLH) ANTENNA DEVICE," filed on Mar. 3, 2010, which is incorporated herein by reference in its entirety.

BACKGROUND

As designers continue to add communication functionality to more and more wireless devices, antenna circuits are developed to communicate in a variety of scenarios. A variety of configurations may be used to implement antennas for these multi-functional devices.

DETAILED DESCRIPTION

Figure 1:
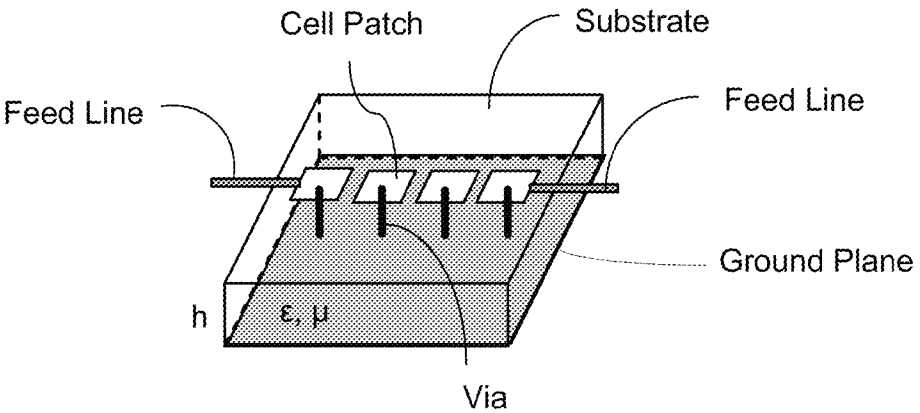
FIGS. 1-3 illustrate Composite Right/Left Handed (CRLH) Metamaterial (MTM) Transmission Line (TL) structures, according to example embodiments.

The following describes a variety of configurations may be used to implement antennas for these multi-functional devices. These include, in some embodiments, an antenna device having a substrate structure, such as formed on Printed Circuit Board, or other structure having conductive layers and dielectric layers. Some antenna devices have one or more metallization layers supported by the substrate structure and structured to include a ground electrode which is formed in one of the one or more metallization layers, and a plurality of electrically conductive parts formed in at least one of the one or more metallization layers and one or more peripheral components, each electrically coupled to at least one of the plurality of electrically conductive parts. The plurality of electrically conductive parts, the one or more peripheral components, and at least part of the substrate structure are configured to form a CRLH antenna device.

In a variety of applications, the available space to incorporate an antenna is limited. Some embodiments may position the antenna structures in available space, wherein the structures have shapes which utilize the available space. Examples of mobile devices include a variety of electronic devices such as cell phones, wireless laptops, and wireless USB dongles. In some of these devices, integrated peripherals may include both conductive and dielectric components that primarily serve a single function in the wireless device. For example, these peripherals may include active components such as a microphone for audio input, a speaker for audio output, a keypad for data entry, or non-active components such as a mechanical hinge, a fastener, or parts of an enclosure. In some applications, the availability of these peripheral may vary depending on the size or available features of the wireless device.

Conventional antennas may be formed using conductive elements associated with the peripheral components. However, these types of antennas typically require large conductive elements and thus make integration in compact mobile devices more challenging. Other problems may include performance issues due unexpected radio frequency (RF) interference caused by the peripheral component at different operating conditions.

To address integration and antenna performance problems associated with conventional antenna devices, antennas based on a combination of metamaterial structures and peripheral components are provided.

Metamaterials are manmade composite materials engineered to produce desired electromagnetic propagation behavior not found in natural media. The term "metamaterial" refers to many variations of these man-made structures, including Transmission-Lines (TL) based on CRLH propagation. A practical implementation of a pure Left-Handed (LH) TL includes Right-Hand (RH) propagation inherited from the lump elemental electrical parameters. This composition including LH and RH propagation or modes, results in unprecedented improvements in air interface integration, Over-The-Air (OTA) performance and miniaturization while simultaneously reducing bill of materials (BOM) costs and SAR values. MTMs enable physically small but electrically large air interface components, with minimal coupling among closely spaced devices. MTM antenna structures in some embodiments are copper printed directly on the dielectric substrate and can be fabricated using a conventional FR-4 substrate or a Flexible Printed Circuit (FPC) board.

A metamaterial structure may be a periodic structure with N identical unit cells cascading together where each cell is much smaller than one wavelength at the operational frequency. A metamaterial structure as used herein may be any RF structure to which is applied capacitive coupling at the feed and inductive loading to ground. In this sense, the composition of one metamaterial unit cell is described by an equivalent lumped circuit model having a series inductor ($L_R$), a series capacitor ($C_L$), shunt inductor ($L_L$) and shunt capacitor ($C_R$) where $L_L$ and $C_L$ determine the LH mode propagation properties while $L_R$ and $C_R$ determine the RH mode propagation properties. The behaviors of both LH and RH mode propagation at different frequencies can be easily addressed in a simple dispersion diagram such as described herein below with respect to FIGS. 7A and 7B. In such a dispersion curve, $\beta>0$ identifies the RH mode while $\beta<0$ identifies the LH mode. An MTM device exhibits a negative phase velocity depending on the operating frequency.

The electrical size of a conventional transmission line is related to its physical dimension, thus reducing device size usually means increasing the range of operational frequencies. Conversely, the dispersion curve of a metamaterial structure depends mainly on the value of the four CRLH parameters, $C_L$, $L_L$, $C_R$, $L_R$. As a result, manipulating the dispersion relations of the CRLH parameters enables a small physical RF circuit having electrically large RF signals. This concept has been adopted successfully in small antenna designs.

In some applications, metamaterial (MTM) and CRLH structures and components are based on a technology which applies the concept of Left-handed (LH) structures. As used herein, the terms "metamaterial," "MTM," "CRLH," "CRLH MTM," as well as "CRLH structure," "MTM based structure," and "CRLH MTM structure," refer to composite LH and RH structures engineered using conventional dielectric and conductive materials to produce unique electromagnetic properties, wherein such a composite unit cell is much smaller than the free space wavelength of the propagating electromagnetic waves.

Metamaterial technology, as used herein, includes technical means, methods, devices, inventions and engineering works which allow compact devices composed of conductive and dielectric parts and are used to receive and transmit electromagnetic waves. Using MTM technology, antennas and RF components may be made very compactly in comparison to competing methods and may be very closely spaced to each other or to other nearby components while at the same time minimizing undesirable interference and electromagnetic coupling. Such antennas and RF components further exhibit useful and unique electromagnetic behavior that results from one or more of a variety of structures to design, integrate, and optimize antennas and RF components inside wireless communications devices CRLH structures are structures that behave as structures exhibiting simultaneous negative permittivity ($\in$) and negative permeability ($\mu$) in a frequency range and simultaneous positive $\in$ and positive $\mu$ in another frequency range. Transmission-Line (TL) based CRLH structure are structures that enable TL propagation and behave as structures exhibiting simultaneous negative permittivity ($\in$) and negative permeability ($\mu$) in a frequency range and simultaneous positive $\in$ and positive $\mu$ in another frequency range. The CRLH based antennas and TLs may be designed and implemented with and without conventional RF design structures.

Antennas, RF components and other devices made of conventional conductive and dielectric parts may be referred to as "MTM antennas," "MTM components," and so forth, when they are designed to behave as an MTM structure. MTM components may be easily fabricated using conventional conductive and insulating materials and standard manufacturing technologies including but not limited to: printing, etching, and subtracting conductive layers on substrates such as FR4, ceramics, LTCC, MMICC, flexible films, plastic or even paper.

CRLH structures can be used to construct antennas, transmission lines and other RF components and devices, allowing for a wide range of technology advancements such as functionality enhancements, size reduction and performance improvements. Unlike conventional antennas, the MTM antenna resonances are affected by the presence of the Left-Handed (LH) mode. In general, the LH mode helps excite and better match the low frequency resonances as well as improves the matching of high frequency resonances. These MTM antenna structures can be fabricated by using a conventional FR-4 Printed Circuit Board (PCB) or a Flexible Printed Circuit (FPC) board. Examples of other fabrication techniques include thin film fabrication technique, System On Chip (SOC) technique, Low Temperature Co-fired Ceramic (LTCC) technique, and Monolithic Microwave Integrated Circuit (MMIC) technique.

The basic structural elements of a CRLH MTM antenna is provided in this disclosure as a review and serve to describe fundamental aspects of CRLH antenna structures used in a balanced MTM antenna device. For example, the one or more antennas in the above and other antenna devices described in this document may be in various antenna structures, including right-handed (RH) antenna structures and CRLH structures. In a right-handed (RH) antenna structure, the propagation of electromagnetic waves obeys the right-hand rule for the (E,H, $\beta$) vector fields, considering the electrical field E, the magnetic field H, and the wave vector $\beta$ (or propagation constant). The phase velocity direction is the same as the direction of the signal energy propagation (group velocity) and the refractive index is a positive number. Such materials are referred to as Right Handed (RH) materials. Most natural materials are RH materials. Artificial materials can also be RH materials.

A metamaterial may be an artificial structure or, as detailed hereinabove, an MTM component may be designed to behave as an artificial structure. In other words, the equivalent circuit describing the behavior and electrical composition of the component is consistent with that of an MTM. When designed with a structural average unit cell size $\rho$ much smaller than the wavelength $\lambda$ of the electromagnetic energy guided by the metamaterial, the metamaterial can behave like a homogeneous medium to the guided electromagnetic energy. Unlike RH materials, a metamaterial can exhibit a negative refractive index, and the phase velocity direction may be opposite to the direction of the signal energy propagation wherein the relative directions of the (E,H,$\beta$) vector fields follow the left-hand rule. Metamaterials having a negative index of refraction and have simultaneous negative permittivity $\in$ and permeability $\mu$ are referred to as pure Left Handed (LH) metamaterials.

Many metamaterials are mixtures of LH metamaterials and RH materials and thus are CRLH metamaterials. A CRLH metamaterial can behave like an LH metamaterial at low frequencies and an RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials." Electronics Letters, Vol. 40, No. 16 (August, 2004).

CRLH metamaterials may be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

Metamaterial structures may be used to construct antennas, transmission lines and other RF components and devices, allowing for a wide range of technology advancements such as functionality enhancements, size reduction and performance improvements. An MTM structure has one or more MTM unit cells. As discussed above, the lumped circuit model equivalent circuit for an MTM unit cell includes an RH series inductance $L_R$, an RH shunt capacitance $C_R$, an LH series capacitance $C_L$, and an LH shunt inductance $L_L$. The MTM-based components and devices can be designed based on these CRLH MTM unit cells that can be implemented by using distributed circuit elements, lumped circuit elements or a combination of both. Unlike conventional antennas, the MTM antenna resonances are affected by the presence of the LH mode. In general, the LH mode helps excite and better match the low frequency resonances as well as improves the matching of high frequency resonances. The MTM antenna structures can be configured to support multiple frequency bands including a "low band" and a "high band." The low band includes at least one LH mode resonance and the high band includes at least one RH mode resonance associated with the antenna signal.

Some examples and implementations of MTM antenna structures are described in the U.S. Patent Applications: Ser. No. 11/741,674 entitled "Antennas, Devices and Systems Based on Metamaterial Structures," filed on Apr. 27, 2007; and the U.S. Pat. No. 7,592,957 entitled "Antennas Based on Metamaterial Structures," issued on Sep. 22, 2009. These MTM antenna structures may be fabricated by using a conventional FR-4 Printed Circuit Board (PCB) or a Flexible Printed Circuit (FPC) board.

One type of MTM antenna structure is a Single-Layer Metallization (SLM) MTM antenna structure, wherein the conductive portions of the MTM structure are positioned in a single metallization layer formed on one side of a substrate. In this way, the CRLH components of the antenna are printed onto one surface or layer of the substrate. For a SLM device, the capacitively coupled portion and the inductive load portions are both printed onto a same side of the substrate.

A Two-Layer Metallization Via-Less (TLM-VL) MTM antenna structure is another type of MTM antenna structure having two metallization layers on two parallel surfaces of a substrate. A TLM-VL does not have conductive vias connecting conductive portions of one metallization layer to conductive portions of the other metallization layer. The examples and implementations of the SLM and TLM-VL MTM antenna structures are described in the U.S. patent application Ser. No. 12/250,477 entitled "Single-Layer Metallization and Via-Less Metamaterial Structures," filed on Oct. 13, 2008, the disclosure of which is incorporated herein by reference.

FIG. 1 illustrates an example of a 1-dimensional (1D) CRLH MTM transmission line (TL) based on four unit cells. One unit cell includes a cell patch and a via, and is a building block for constructing a desired MTM structure. The illustrated TL example includes four unit cells formed in two conductive metallization layers of a substrate where four conductive cell patches are formed on the top conductive metallization layer of the substrate and the other side of the substrate has a metallization layer as the ground electrode. Four centered conductive vias are formed to penetrate through the substrate to connect the four cell patches to the ground plane, respectively. The unit cell patch on the left side is electromagnetically coupled to a first feed line and the unit cell patch on the right side is electromagnetically coupled to a second feed line. In some implementations, each unit cell patch is electromagnetically coupled to an adjacent unit cell patch without being directly in contact with the adjacent unit cell. This structure forms the MTM transmission line to receive an RF signal from one feed line and to output the RF signal at the other feed line.

Figure 2:
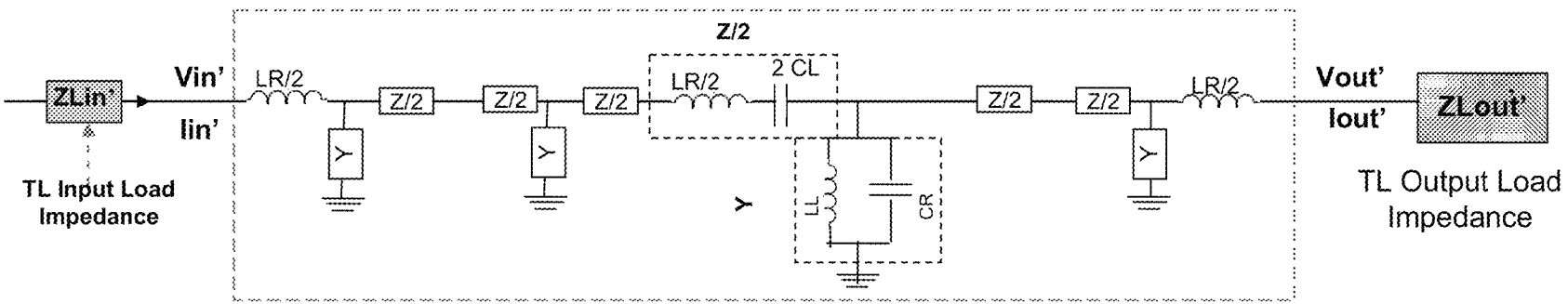

FIG. 2 shows an equivalent network circuit of the 1D CRLH MTM TL in FIG. 1. The ZLin' and ZLout' correspond to the TL input load impedance and TL output load impedance, respectively, and are due to the TL coupling at each end. This is an example of a printed two-layer structure. $L_R$ is due to the cell patch and the first feed line on the dielectric substrate, and $C_R$ is due to the dielectric substrate being sandwiched between the cell patch and the ground plane. $C_L$ is due to the presence of two adjacent cell patches, and the via induces $L_L$.

Each individual unit cell can have two resonances $\omega_{SE}$ and $\omega_{SH}$ corresponding to the series (SE) impedance Z and shunt (SH) admittance Y. In FIG. 2, the Z/2 block includes a series combination of LR/2 and 2CL, and the Y block includes a parallel combination of $L_L$ and $C_R$. The relationships among these parameters are expressed as follows:

$$\omega_{SH} = \frac{1}{\sqrt{L_L C_R}};\ \omega_{SE} = \frac{1}{\sqrt{L_R C_L}};\ \omega_R = \frac{1}{\sqrt{L_R C_R}};\quad \text{Eq. (1)}$$

$$\omega_L = \frac{1}{\sqrt{L_L C_L}}$$

$$\text{where, } Z = j\omega L_R + \frac{1}{j\omega C_L} \text{ and } Y = j\omega C_R + \frac{1}{j\omega L_L}.$$

The two unit cells at the input/output edges in FIG. 1 do not include $C_L$, since $C_L$ represents the capacitance between two adjacent cell patches and is missing at these input/output edges. The absence of the $C_L$ portion at the edge unit cells prevents $\omega_{SE}$ frequency from resonating. Therefore, only $\omega_{SH}$ appears as an m=0 resonance frequency.

Figure 3:
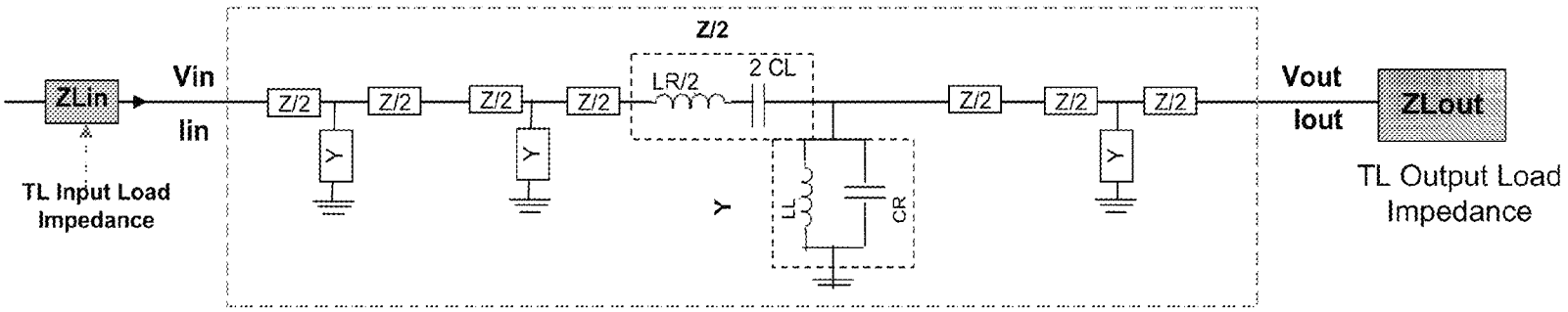

To simplify the computational analysis, a portion of the ZLin' and ZLout' series capacitor is included to compensate for the missing $C_L$ portion, and the remaining input and output load impedances are denoted as ZLin and ZLout, respectively, as seen in FIG. 3. Under this condition, ideally the unit cells have identical parameters as represented by two series Z/2 blocks and one shunt Y block in FIG. 3, where the Z/2 block includes a series combination of $L_R/2$ and $2C_L$, and the Y block includes a parallel combination of $L_L$ and $C_R$.

Figure 4A:
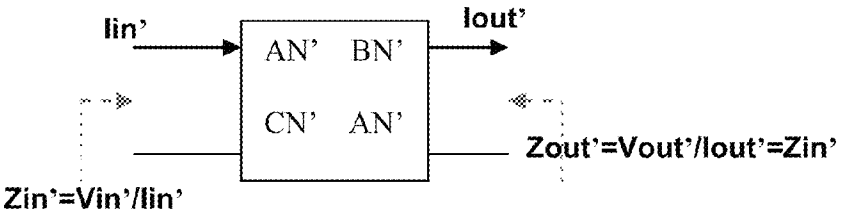
FIGS. 4A and 4B illustrate two-port network matrix representations for the structures of FIGS. 1-3, according to an example embodiments.
Figure 4B:
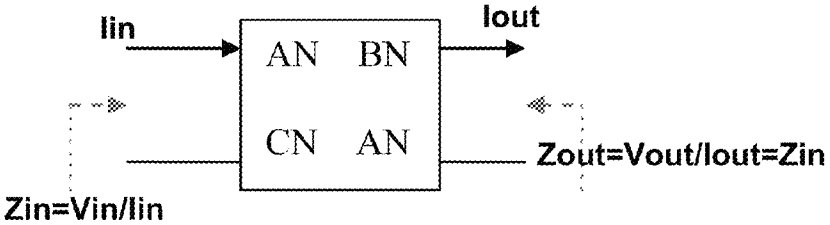

FIG. 4A and FIG. 4B illustrate a two-port network matrix representation for TL circuits without the load impedances as shown in FIG. 2 and FIG. 3, respectively. The matrix coefficients describing the input-output relationship are provided.

Figure 5:
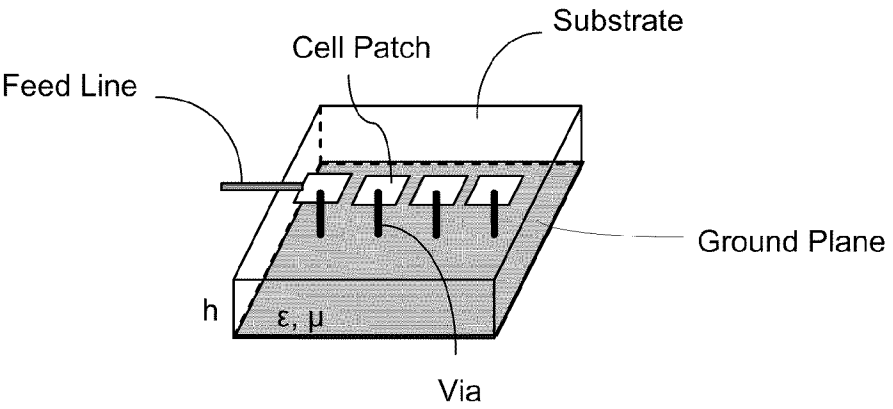
FIG. 5 illustrates a CRLH MTM antenna structure, according to an example embodiment.

FIG. 5 illustrates an example of a 1D CRLH MTM antenna based on four unit cells. Different from the 1D CRLH MTM TL in FIG. 1, the antenna in FIG. 5 couples the unit cell on the left side to a feed line to connect the antenna to a antenna circuit and the unit cell on the right side is an open circuit so that the four cells interface with the air to transmit or receive an RF signal.

Figure 6B:
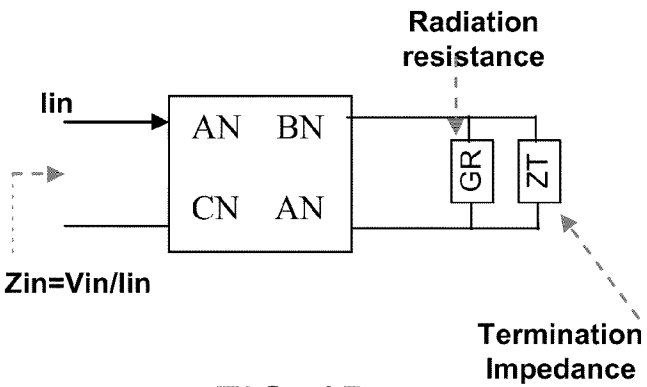
FIGS. 6A and 6B illustrate two-port network matrix representations for the CRLH MTM antenna structures as in FIGS. 4A and 4B, according to example embodiments.
Figure 6A:
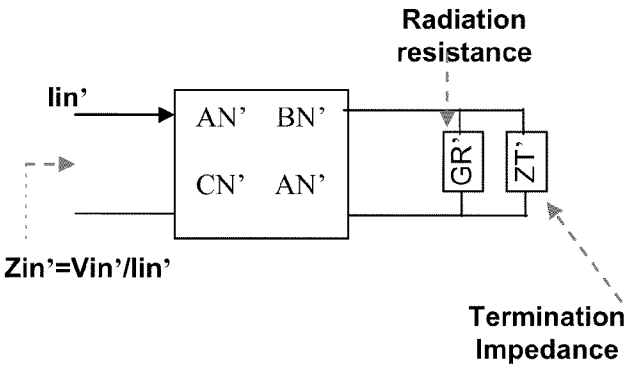

FIG. 6A shows a two-port network matrix representation for the antenna circuit in FIG. 5. FIG. 6B shows a two-port network matrix representation for the antenna circuit in FIG. 5 with the modification at the edges to account for the missing $C_L$ portion to have all the unit cells identical. FIGS. 6A and 6B are analogous to the TL circuits shown in FIGS. 4A and 4B, respectively.

In matrix notations, FIG. 4B represents the relationship given as below:

$$\begin{pmatrix} Vin \\ Iin \end{pmatrix} = \begin{pmatrix} AN & BN \\ CN & AN \end{pmatrix} \begin{pmatrix} Vout \\ Iout \end{pmatrix}, \quad \text{Eq. (2)}$$

where AN=DN because the CRLH MTM TL circuit in FIG. 3 is symmetric when viewed from Vin and Vout ends.

In FIGS. 6A and 6B, the parameters GR' and GR represent a radiation resistance, and the parameters ZT' and ZT represent a termination impedance. Each of ZT', ZLin' and ZLout' includes a contribution from the additional $2C_L$ as expressed below:

$$ZLin' = ZLin + \frac{2}{j\omega CL}, \; ZLout' = ZLout + \frac{2}{j\omega CL}, \quad \text{Eq. (3)}$$

$$ZT' = ZT + \frac{2}{j\omega CL}.$$

Since the radiation resistance GR or GR' can be derived by either building or simulating the antenna, it may be difficult to optimize the antenna design. Therefore, it is preferable to adopt the TL approach and then simulate its corresponding antennas with various terminations ZT. The relationships in Eq. (1) are valid for the circuit in FIG. 2 with the modified values AN', BN', and CN', which reflect the missing $C_L$ portion at the two edges.

The frequency bands can be determined from the dispersion equation derived by letting the N CRLH cell structure resonate with $n\pi$ propagation phase length, where n=0, ±1, ±2, . . . ±N. Here, each of the N CRLH cells is represented by Z and Y in Eq. (1), which is different from the structure shown in FIG. 2, where $C_L$ is missing from end cells. Therefore, one might expect that the resonances associated with these two structures are different. However, extensive calculations show that all resonances are the same except for n=0, where both $\omega_{SE}$ and $\omega_{SH}$ resonate in the structure in FIG. 3, and only $\omega_{SH}$ resonates in the structure in FIG. 2. The positive phase offsets (n>0) correspond to RH region resonances and the negative values (n<0) are associated with LH region resonances.

The dispersion relation of N identical CRLH cells with the Z and Y parameters is given below:

$$\begin{cases} N\beta p = \cos^{-1}(A_N), \; \Rightarrow |A_N| \le 1 \Rightarrow 0 \le \chi = -ZY \le 4 \forall N \\ \quad \text{where } A_N = 1 \text{ at even resonances} \\ |n| = 2m \in \left\{0, 2, 4, \ldots \; 2 \times \mathrm{Int}\left(\frac{N-1}{2}\right)\right\} \\ \quad \text{and } A_N = -1 \text{ at odd resonances} \\ |n| = 2m+1 \in \left\{1, 3, \ldots \left(2 \times \mathrm{Int}\left(\frac{N}{2}\right) - 1\right)\right\}, \end{cases} \quad \text{Eq. (4)}$$

where Z and Y are given in Eq. (1), AN is derived from the linear cascade of N identical CRLH unit cells as in FIG. 3, and p is the cell size. Odd n=(2 m+1) and even n=2m resonances are associated with AN=−1 and AN=1, respectively. For AN' in FIG. 4A and FIG. 6A, the n=0 mode resonates at $\omega_0=\omega_{SH}$ only and not at both $\omega_{SE}$ and $\omega_{SH}$ due to the absence of $C_L$ at the end cells, regardless of the number of cells. Higher-order frequencies are given by the following equations for the different values of $\chi$ specified in Table 1:

For $n > 0$, Eq. (5)

$$\omega_{\pm n}^2 = \frac{\omega_{SH}^2 + \omega_{SE}^2 + \chi\omega_R^2}{2} \pm \sqrt{\left(\frac{\omega_{SH}^2 + \omega_{SE}^2 + \chi\omega_R^2}{2}\right)^2 - \omega_{SH}^2\omega_{SE}^2}.$$

Eq. (5)

Table 1 provides $\chi$ values for N=1, 2, 3, and 4. It should be noted that the higher-order resonances |n|>0 are the same regardless if the full $C_L$ is present at the edge cells (FIG. 3) or absent (FIG. 2). Furthermore, resonances close to n=0 have small $\chi$ values (near $\chi$ lower bound 0), whereas higher-order resonances tend to reach $\chi$ upper bound 4 as stated in Eq. (4).

TABLE 1

Resonances for N= 1, 2, 3 and 4 cells

| N\Modes | \|n\| = 0 | \|n\| = 1 | \|n\| = 2 | \|n\| = 3 |
|---|---|---|---|---|
| N = 1 | $\chi_{(1,0)} = 0$; $\omega_0 = \omega_{SH}$ | | | |
| N = 2 | $\chi_{(2,0)} = 0$; $\omega_0 = \omega_{SH}$ | $\chi_{(2,1)} = 2$ | | |
| N = 3 | $\chi_{(3,0)} = 0$; $\omega_0 = \omega_{SH}$ | $\chi_{(3,1)} = 1$ | $\chi_{(3,2)} = 3$ | |
| N = 4 | $\chi_{(4,0)} = 0$; $\omega_0 = \omega_{SH}$ | $\chi_{(4,1)} = 2 - \sqrt{2}$ | $\chi_{(4,2)} = 2$ | |

Figure 7A:
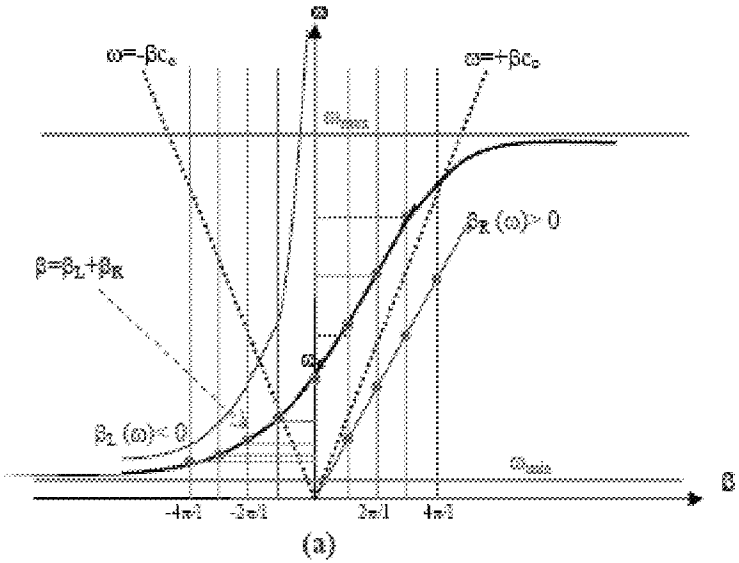
FIGS. 7A and 7B illustrate dispersion curves for the balanced case and the unbalanced case, respectively, according to example embodiments.
Figure 7B:
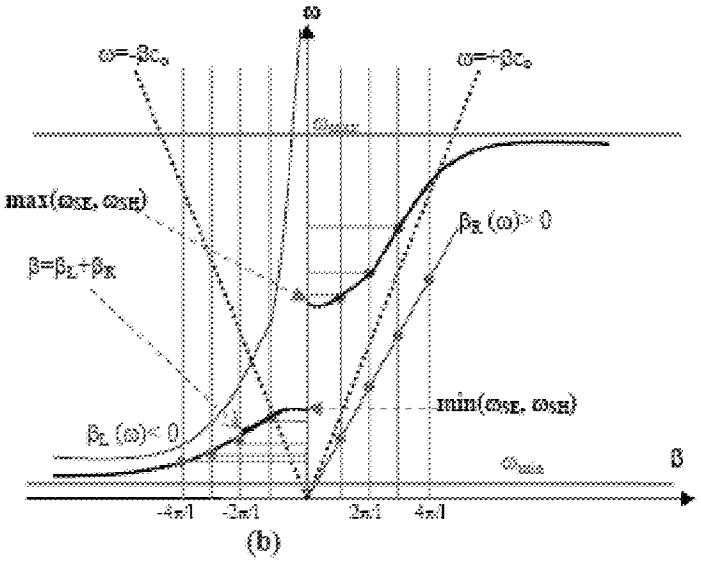

The CRLH dispersion curve β for a unit cell as a function of frequency ω is illustrated in FIGS. 7A and 7B for the $\omega_{SE}=\omega_{SH}$ (balanced, i.e., $L_R C_L = L_L C_R$) and $\omega_{SE}\neq\omega_{SH}$ (unbalanced) cases, respectively. In the latter case, there is a frequency gap between $\min(\omega_{SE},\omega_{SH})$ and $\max(\omega_{SE},\omega_{SH})$. The limiting frequencies w and $\omega_{max}$ values are given by the same resonance equations in Eq. (5) with $\chi$ reaching its upper bound $\chi$=4 as stated in the following equations:

$$\omega_{min}^2 = \frac{\omega_{SH}^2 + \omega_{SE}^2 + 4\omega_R^2}{2} - \sqrt{\left(\frac{\omega_{SH}^2 + \omega_{SE}^2 + 4\omega_R^2}{2}\right)^2 - \omega_{SH}^2\omega_{SE}^2} \quad (6)$$

$$\omega_{max}^2 = \frac{\omega_{SH}^2 + \omega_{SE}^2 + 4\omega_R^2}{2} + \sqrt{\left(\frac{\omega_{SH}^2 + \omega_{SE}^2 + 4\omega_R^2}{2}\right)^2 - \omega_{SH}^2\omega_{SE}^2}.$$

In addition, FIGS. 7A and 7B provide examples of the resonance position along the dispersion curves. In the RH region (n>0) the structure size l=Np, where p is the cell size, increases with decreasing frequency. In contrast, in the LH region, lower frequencies are reached with smaller values of Np, hence size reduction. The dispersion curves provide some indication of the bandwidth around these resonances. For instance, LH resonances have the narrow bandwidth because the dispersion curves are almost flat. In the RH region, the bandwidth is wider because the dispersion curves are steeper. Thus, the first condition to obtain broadbands, $1^{st}$ BB condition, can be expressed as follows:

$$COND1\text{: } 1^{st}BB \text{ condition } \left|\frac{d\beta}{d\omega}\right|_{res} = \left|-\frac{\frac{d(AN)}{d\omega}}{\sqrt{(1-AN^2)}}\right|_{res} << 1 \text{near } \omega = \omega_{res} = \omega_0, \quad \text{Eq. (7)}$$

$$\omega_{\pm 1}, \omega_{\pm 2} \ldots \Rightarrow \left|\frac{d\beta}{d\omega}\right| = \left|\frac{\frac{d\chi}{d\omega}}{2p\sqrt{\chi\left(1-\frac{\chi}{4}\right)}}\right|_{res} << 1$$

with $$p = \text{cell size and } \frac{d\chi}{d\omega}\bigg|_{res} = \frac{2\omega_{\pm n}}{\omega_R^2}\left(1-\frac{\omega_{SE}^2\omega_{SH}^2}{\omega_{\pm n}}\right),$$

where $\chi$ is given in Eq. (4) and $\omega_R$ is defined in Eq. (1). The dispersion relation in Eq. (4) indicates that resonances occur when $|AN|=1$, which leads to a zero denominator in the $1^{st}$ BB condition (COND1) of Eq. (7). As a reminder, AN is the first transmission matrix entry of the N identical unit cells (FIG. 4B and FIG. 6B). The calculation shows that COND1 is indeed independent of N and given by the second equation in Eq. (7). It is the values of the numerator and $\chi$ at resonances, which are shown in Table 1, that define the slopes of the dispersion curves, and hence possible bandwidths. Targeted structures are at most $Np=\lambda/40$ in size with the bandwidth exceeding 4%. For structures with small cell sizes p, Eq. (7) indicates that high $\omega_R$ values satisfy COND1, i.e., low $C_R$ and $L_R$ values, since for n<0 resonances occur at $\chi$ values near 4 in Table 1, in other terms $(1-\lambda/4\rightarrow 0)$.

As previously indicated, once the dispersion curve slopes have steep values, then the next step is to identify suitable matching. Ideal matching impedances have fixed values and may not require large matching network footprints. Here, the word "matching impedance" refers to a feed line and termination in the case of a single side feed such as in antennas. To analyze an input/output matching network, Zin and Zout can be computed for the TL circuit in FIG. 4B. Since the network in FIG. 3 is symmetric, it is straightforward to demonstrate that Zin=Zout. It can be demonstrated that Zin is independent of N as indicated in the equation below:

$$Zin^2 = \frac{BN}{CN} = \frac{B1}{C1} = \frac{Z}{Y}\left(1-\frac{\chi}{4}\right), \quad \text{Eq. (8)}$$

which has only positive real values. One reason that B1/C1 is greater than zero is due to the condition of $|AN|\leq 1$ in Eq. (4), which leads to the following impedance condition:

$$0\leq -ZY=\chi\leq 4.$$

The $2^{nd}$ broadband (BB) condition is for Zin to slightly vary with frequency near resonances in order to maintain constant matching. Remember that the real input impedance Zin' includes a contribution from the $C_L$ series capacitance as stated in Eq. (3). The $2^{nd}$ BB condition is given below:

$$COND2\text{: } 2^{ed} BB \text{ condition: near resonances, } \frac{dZin}{d\omega}\bigg|_{near\ res} << 1. \quad \text{Eq. (9)}$$

Different from the transmission line example in FIG. 2 and FIG. 3, antenna designs have an open-ended side with an infinite impedance which poorly matches the structure edge impedance. The capacitance termination is given by the equation below:

$$Z_T = \frac{AN}{CN}, \quad \text{Eq. (10)}$$

which depends on N and is purely imaginary. Since LH resonances are typically narrower than RH resonances, selected matching values are closer to the ones derived in the n<0 region than the n>0 region.

One method to increase the bandwidth of LH resonances is to reduce the shunt capacitor CR. This reduction can lead to higher $\omega_R$ values of steeper dispersion curves as explained in Eq. (7). There are various methods of decreasing CR, including but not limited to: 1) increasing substrate thickness, 2) reducing the cell patch area, 3) reducing the ground area under the top cell patch, resulting in a "truncated ground," or combinations of the above techniques.

The MTM TL and antenna structures in FIGS. 1 and 5 use a conductive layer to cover the entire bottom surface of the substrate as the full ground electrode. A truncated ground electrode that has been patterned to expose one or more portions of the substrate surface can be used to reduce the area of the ground electrode to less than that of the full substrate surface. This can increase the resonant bandwidth and tune the resonant frequency. Two examples of a truncated ground structure are discussed with reference to FIGS. 8 and 11, where the amount of the ground electrode in the area in the footprint of a cell patch on the ground electrode side of the substrate has been reduced, and a remaining strip line (via line) is used to connect the via of the cell patch to a main ground electrode outside the footprint of the cell patch. This truncated ground approach may be implemented in various configurations to achieve broadband resonances.

Figure 8:
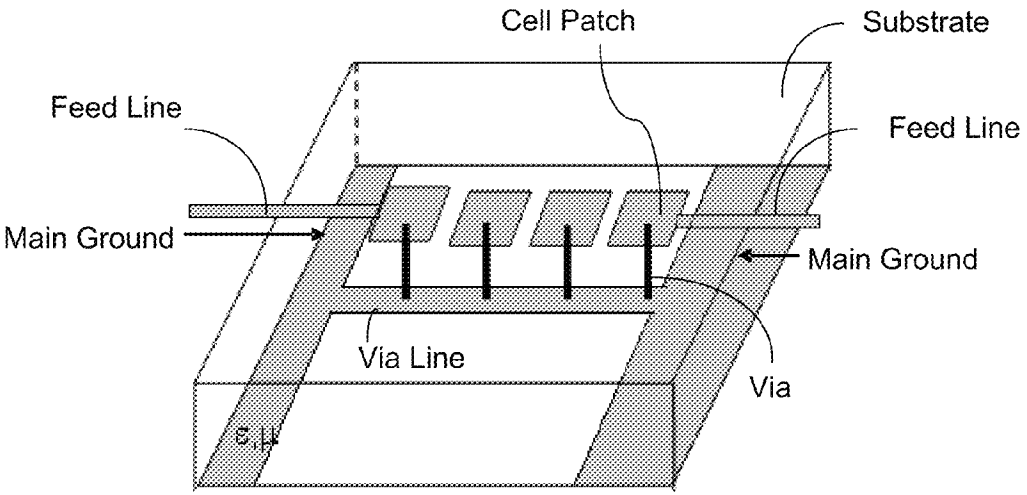
FIGS. 8-12 illustrate CRLH MTM TL structures with truncated ground, according to an example embodiments.
Figure 9:
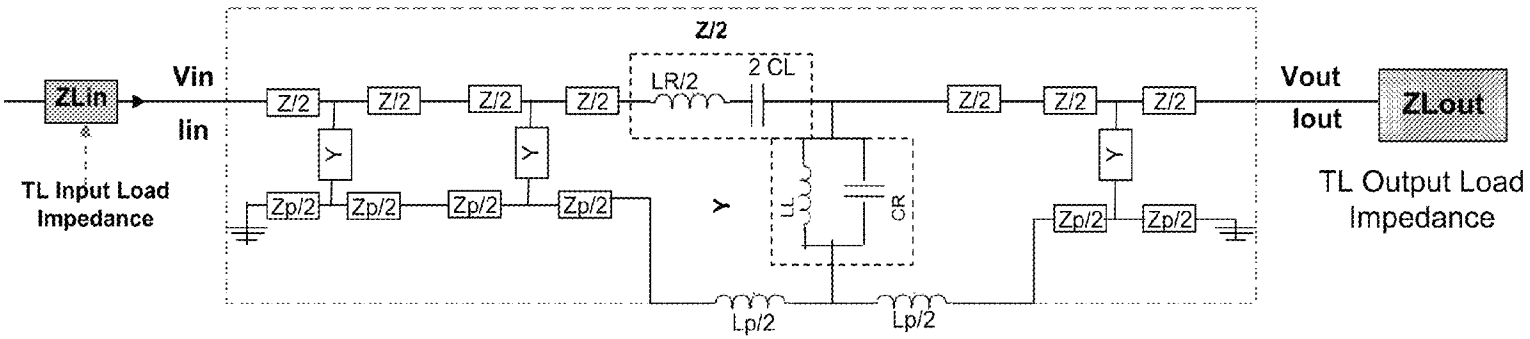
Figure 10:
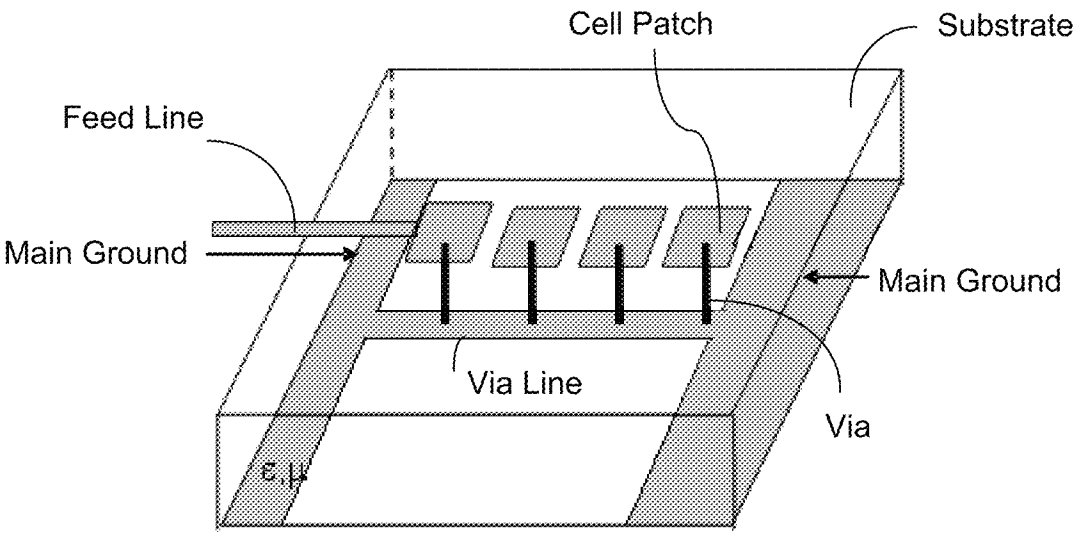

FIG. 8 illustrates one example of a truncated ground electrode for a four-cell MTM transmission line where the ground electrode has a dimension that is less than the cell patch along one direction underneath the cell patch. The ground conductive layer includes a via line that is connected to the vias and passes through underneath the cell patches. The via line has a width that is less than a dimension of the cell path of each unit cell. The use of a truncated ground may be a preferred choice over other methods in implementations of commercial devices where the substrate thickness cannot be increased or the cell patch area cannot be reduced because of the associated decrease in antenna efficiencies. When the ground is truncated, another inductor Lp (FIG. 9) is introduced by the metallization strip (via line) that connects the vias to the main ground as illustrated in FIG. 8. FIG. 10 shows a four-cell antenna counterpart with the truncated ground analogous to the TL structure in FIG. 8.

Figure 11:
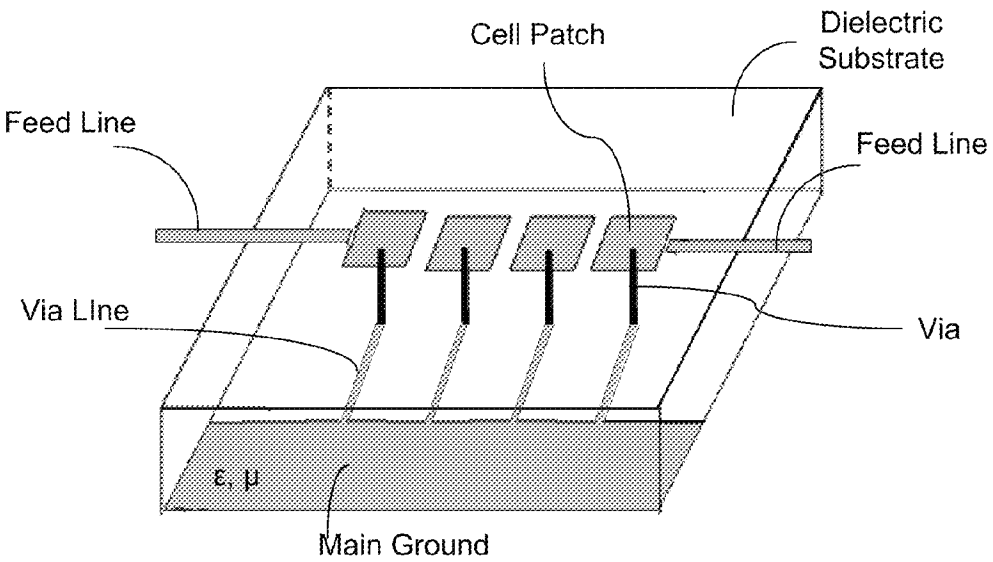

FIG. 11 illustrates another example of a MTM antenna having a truncated ground structure. In this example, the ground conductive layer includes via lines and a main ground that is formed outside the footprint of the cell patches. Each via line is connected to the main ground at a first distal end and is connected to the via at a second distal end. The via line has a width that is less than a dimension of the cell path of each unit cell.

The equations for the truncated ground structure can be derived. In the truncated ground examples, the shunt capacitance $C_R$ becomes small, and the resonances follow the same equations as in Eqs. (1), (5) and (6) and Table 1. Two approaches are presented. FIGS. 8 and 9 represent the first approach, Approach 1, wherein the resonances are the same as in Eqs. (1), (5) and (6) and Table 1 after replacing $L_R$ by (LR+Lp). For $|n|\neq 0$, each mode has two resonances corresponding to (1) $\omega\pm n$ for $L_R$ being replaced by ($L_R$+Lp) and (2) $\omega\pm n$ for $L_R$ being replaced by ($L_R$+Lp/N) where N is the number of unit cells. Under this Approach 1, the impedance equation becomes:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)}, \quad \text{Eq. (11)}$$

$$\text{where } \chi = -YZ \text{ and } \chi = -YZ_P,$$

where Zp=jωLp and Z, Y are defined in Eq. (2). The impedance equation in Eq. (11) provides that the two resonances ω and ω' have low and high impedances, respectively. Thus, it is easy to tune near the ω resonance in most cases.

Figure 12:
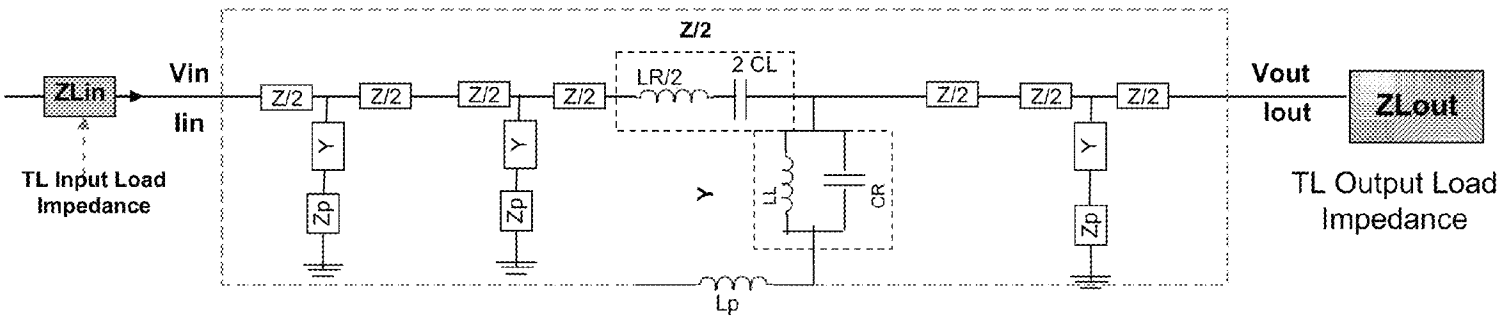

The second approach, Approach 2, is illustrated in FIGS. 11 and 12 and the resonances are the same as in Eqs. (1), (5), and (6) and Table 1 after replacing $L_L$ by ($L_L$+Lp). In the second approach, the combined shunt inductor ($L_L$+Lp) increases while the shunt capacitor $C_R$ decreases, which leads to lower LH frequencies.

The above MTM structures are formed on two metallization layers and one of the two metallization layers is used as the ground electrode and is connected to the other metallization layer through a conductive via. Such two-layer CRLH MTM TLs and antennas with a via can be constructed with a full ground electrode as shown in FIGS. 1 and 5 or a truncated ground electrode as shown in FIGS. 8 and 10.

In one embodiment, an SLM MTM structure includes a substrate having a first substrate surface and an opposite substrate surface, a metallization layer formed on the first substrate surface and patterned to have two or more conductive portions to form the SLM MTM structure without a conductive via penetrating the dielectric substrate. The conductive portions in the metallization layer include a cell patch of the SLM MTM structure, a ground that is spatially separated from the cell patch, a via line that interconnects the ground and the cell patch, and a feed line that is capacitively coupled to the cell patch without being directly in contact with the cell patch. The LH series capacitance $C_L$ is generated by the capacitive coupling through the gap between the feed line and the cell patch. The RH series inductance $L_R$ is mainly generated in the feed line and the cell patch. There is no dielectric material vertically sandwiched between the two conductive portions in this SLM MTM structure. As a result, the RH shunt capacitance $C_R$ of the SLM MTM structure may be designed to be negligibly small. A small RH shunt capacitance $C_R$ can still be induced between the cell patch and the ground, both of which are in the single metallization layer. The LH shunt inductance $L_L$ in the SLM MTM structure is negligible due to the absence of the via penetrating the substrate, but the via line connected to the ground can generate inductance equivalent to the LH shunt inductance $L_L$. A TLM-VL MTM antenna structure may have the feed line and the cell patch positioned in two different layers to generate vertical capacitive coupling.

Different from the SLM and TLM-VL MTM antenna structures, a multilayer MTM antenna structure has conductive portions in two or more metallization layers which are connected by at least one via. The examples and implementations of such multilayer MTM antenna structures are described in the U.S. patent application Ser. No. 12/270,410 entitled "Metamaterial Structures with Multilayer Metallization and Via," filed on Nov. 13, 2008, the disclosure of which is incorporated herein by reference. These multiple metallization layers are patterned to have multiple conductive portions based on a substrate, a film or a plate structure where two adjacent metallization layers are separated by an electrically insulating material (e.g., a dielectric material). Two or more substrates may be stacked together with or without a dielectric spacer to provide multiple surfaces for the multiple metallization layers to achieve certain technical features or advantages. Such multilayer MTM structures may implement at least one conductive via to connect one conductive portion in one metallization layer to another conductive portion in another metallization layer. This allows connection of one conductive portion in one metallization layer to another conductive portion in the other metallization layer.

An implementation of a double-layer MTM antenna structure with a via includes a substrate having a first substrate surface and a second substrate surface opposite to the first surface, a first metallization layer formed on the first substrate surface, and a second metallization layer formed on the second substrate surface, where the two metallization layers are patterned to have two or more conductive portions with at least one conductive via connecting one conductive portion in the first metallization layer to another conductive portion in the second metallization layer. A truncated ground can be formed in the first metallization layer, leaving part of the surface exposed. The conductive portions in the second metallization layer can include a cell patch of the MTM structure and a feed line, the distal end of which is located close to and capacitively coupled to the cell patch to transmit an antenna signal to and from the cell patch. The cell patch is formed in parallel with at least a portion of the exposed surface. The conductive portions in the first metallization layer include a via line that connects the truncated ground in the first metallization layer and the cell patch in the second metallization layer through a via formed in the substrate. The LH series capacitance $C_L$ is generated by the capacitive coupling through the gap between the feed line and the cell patch. The RH series inductance $L_R$ is mainly generated in the feed line and the cell patch. The LH shunt inductance $L_L$ is mainly induced by the via and the via line. The RH shunt capacitance $C_R$ is mainly induced between the cell patch in the second metallization layer and a portion of the via line in the footprint of the cell patch projected onto the first metallization layer. An additional conductive line, such as a meander line, can be attached to the feed line to induce an RH monopole resonance to support a broadband or multiband antenna operation.

Examples of various frequency bands that can be supported by MTM antennas include frequency bands for cell phone and mobile device applications, WiFi applications, WiMax applications and other wireless communication applications. Examples of the frequency bands for cell phone and mobile device applications are: the cellular band (824-960 MHz) which includes two bands, CDMA (824-894 MHz) and GSM (880-960 MHz) bands; and the PCS/DCS band (1710-2170 MHz) which includes three bands, DCS (1710-1880 MHz), PCS (1850-1990 MHz) and AWS/WCDMA (2110-2170 MHz) bands.

A CRLH structure can be specifically tailored to comply with requirements of an application, such as PCB spatial constraints and layout factors, device performance requirements and other specifications. The cell patch in the CRLH structure can have a variety of geometrical shapes and dimensions, including, for example, rectangular, polygonal, irregular, circular, oval, or combinations of different shapes. The via line and the feed line can also have a variety of geometrical shapes and dimensions, including, for example, rectangular, polygonal, irregular, zigzag, spiral, meander or combinations of different shapes. The distal end of the feed line can be modified to form a launch pad to modify the capacitive coupling. Other capacitive coupling techniques may include forming a vertical coupling gap between the cell patch and the launch pad. The launch pad can have a variety of geometrical shapes and dimensions, including, e.g., rectangular, polygonal, irregular, circular, oval, or combinations of different shapes. The gap between the launch pad and cell patch can take a variety of forms, including, for example, straight line, curved line, L-shaped line, zigzag line, discontinuous line, enclosing line, or combinations of different forms. Some of the feed line, launch pad, cell patch and via line can be formed in different layers from the others. Some of the feed line, launch pad, cell patch and via line can be extended from one metallization layer to a different metallization layer. The antenna portion can be placed a few millimeters above the main substrate. Multiple cells may be cascaded in series to form a multi-cell 1D structure. Multiple cells may be cascaded in orthogonal directions to form a 2D structure. In some implementations, a single feed line may be configured to deliver power to multiple cell patches. In other implementations, an additional conductive line may be added to the feed line or launch pad in which this additional conductive line can have a variety of geometrical shapes and dimensions, including, for example, rectangular, irregular, zigzag, planar spiral, vertical spiral, meander, or combinations of different shapes. The additional conductive line can be placed in the top, mid or bottom layer, or a few millimeters above the substrate.

Another type of MTM antenna includes non-planar MTM antennas. Such non-planar MTM antenna structures arrange one or more antenna sections of an MTM antenna away from one or more other antenna sections of the same MTM antenna so that the antenna sections of the MTM antenna are spatially distributed in a non-planar configuration to provide a compact structure adapted to fit to an allocated space or volume of a wireless communication device, such as a portable wireless communication device. For example, one or more antenna sections of the MTM antenna can be located on a dielectric substrate while placing one or more other antenna sections of the MTM antenna on another dielectric substrate so that the antenna sections of the MTM antenna are spatially distributed in a non-planar configuration such as an L-shaped antenna configuration. In various applications, antenna portions of an MTM antenna can be arranged to accommodate various parts in parallel or non-parallel layers in a three-dimensional (3D) substrate structure. Such non-planar MTM antenna structures may be wrapped inside or around a product enclosure. The antenna sections in a non-planar MTM antenna structure can be arranged to engage to an enclosure, housing walls, an antenna carrier, or other packaging structures to save space. In some implementations, at least one antenna section of the non-planar MTM antenna structure is placed substantially parallel with and in proximity to a nearby surface of such a packaging structure, where the antenna section can be inside or outside of the packaging structure. In some other implementations, the MTM antenna structure can be made conformal to the internal wall of a housing of a product, the outer surface of an antenna carrier or the contour of a device package. Such non-planar MTM antenna structures can have a smaller footprint than that of a similar MTM antenna in a planar configuration and thus can be fit into a limited space available in a portable communication device such as a cellular phone. In some non-planar MTM antenna designs, a swivel mechanism or a sliding mechanism can be incorporated so that a portion or the whole of the MTM antenna can be folded or slid in to save space while unused. Additionally, stacked substrates may be used with or without a dielectric spacer to support different antenna sections of the MTM antenna and incorporate a mechanical and electrical contact between the stacked substrates to utilize the space above the main board.

Non-planar, 3D MTM antennas can be implemented in various configurations. For example, the MTM cell segments described herein may be arranged in non-planar, 3D configurations for implementing a design having tuning elements formed near various MTM structures. U.S. patent application Ser. No. 12/465,571 filed on May 13, 2009 and entitled "Non-Planar Metamaterial Antenna Structures", for example, discloses 3D antennas structure that can implement tuning elements near MTM structures. The entire disclosure of the application Ser. No. 12/465,571 is incorporated by reference as part of the disclosure of this document.

In one aspect, the application Ser. No. 12/465,571 discloses an antenna device to include a device housing comprising walls forming an enclosure and a first antenna part located inside the device housing and positioned closer to a first wall than other walls, and a second antenna part. The first antenna part includes one or more first antenna components arranged in a first plane close to the first wall. The second antenna part includes one or more second antenna components arranged in a second plane different from the first plane. This device includes a joint antenna part connecting the first and second antenna parts so that the one or more first antenna components of the first antenna section and the one or more second antenna components of the second antenna part are electromagnetically coupled to form a CRLH MTM antenna supporting at least one resonance frequency in an antenna signal and having a dimension less than one half of one wavelength of the resonance frequency. In another aspect, the application Ser. No. 12/465,571 discloses an antenna device structured to engage a packaging structure. This antenna device includes a first antenna section configured to be in proximity to a first planar section of the packaging structure and the first antenna section includes a first planar substrate, and at least one first conductive portion associated with the first planar substrate. A second antenna section is provided in this device and is configured to be in proximity to a second planar section of the packaging structure. The second antenna section includes a second planar substrate, and at least one second conductive portion associated with the second planar substrate. This device also includes a joint antenna section connecting the first and second antenna sections. The at least one first conductive portion, the at least one second conductive portion and the joint antenna section collectively form a CRLH MTM structure to support at least one frequency resonance in an antenna signal. In yet another aspect, the application Ser. No. 12/465,571 discloses an antenna device structured to engage to an packaging structure and including a substrate having a flexible dielectric material and two or more conductive portions associated with the substrate to form a CRLH MTM structure configured to support at least one frequency resonance in an antenna signal. The CRLH MTM structure is sectioned into a first antenna section configured to be in proximity to a first planar section of the packaging structure, a second antenna section configured to be in proximity to a second planar section of the packaging structure, and a third antenna section that is formed between the first and second antenna sections and bent near a corner formed by the first and second planar sections of the packaging structure.

The structures described above have a variety of shapes and may be build using one or multiple conductive layers. The structures may also incorporate conductive material used to build or implement other features of a device. Forming antennas from conductive elements associated with the peripheral components may be a challenge for conventional antenna designs in compact mobile devices. To address integration and antenna performance problems, typically associated with conventional antennas, antenna devices, based on a combination of CRLH structures and peripheral components are provided.

Figure 13:
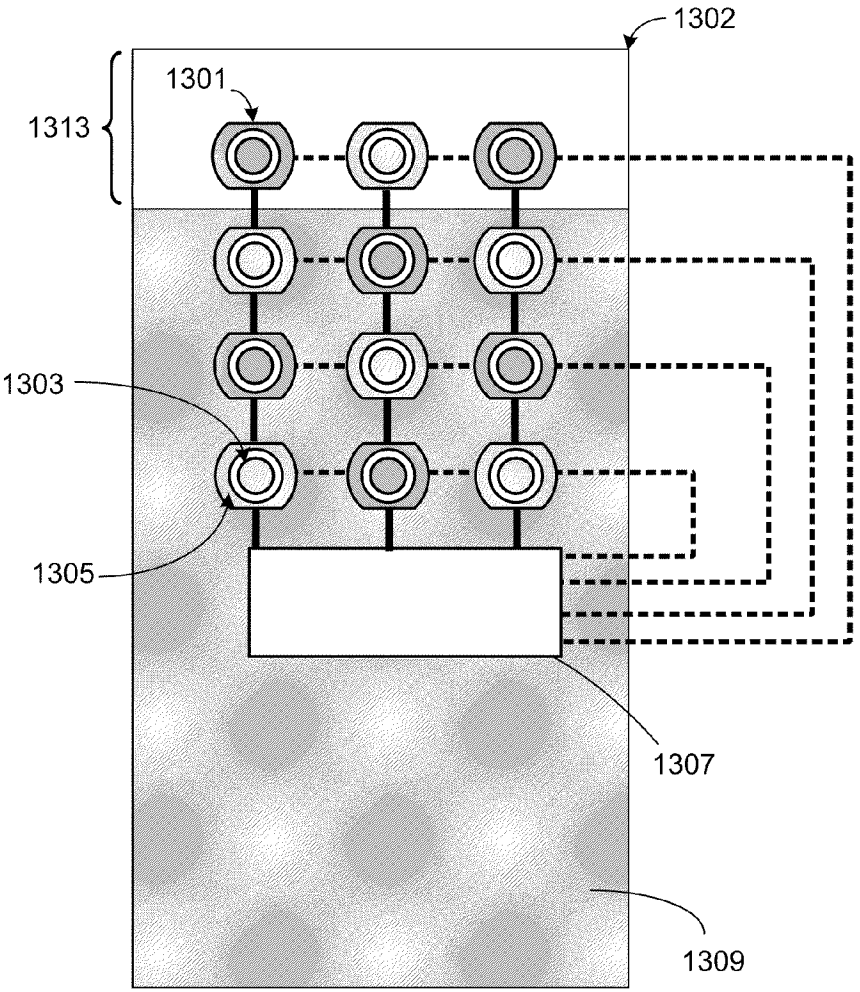
FIG. 13 illustrates a top view of a top layer of a Printed Circuit Board (PCB) keypad layout associated with a compact mobile device, according to an example embodiment.

FIG. 13 illustrates a top view of a top layer of a printed circuit board (PCB) keypad associated with a mobile device. The keypad includes several alpha-numeric keys interconnected to one another to form a 4×3 selectable key matrix. Each key may include a contact switch for providing a signal to a microcontroller 1307, depending on which key is pressed. Multiple key dome structures 1301 are formed for each key on a top and a bottom surface of a substrate 1302. Each key dome structure 1301 includes an inner conductive ring 1303 and an outer conductive ring 1305. Placement of some of the key dome structures 1301 may overlap with a ground plane 1309 while other key dome structures 1301 may overlap with an antenna section 1313 of the substrate 1302, away from the ground plane 1309.

Figure 14A:
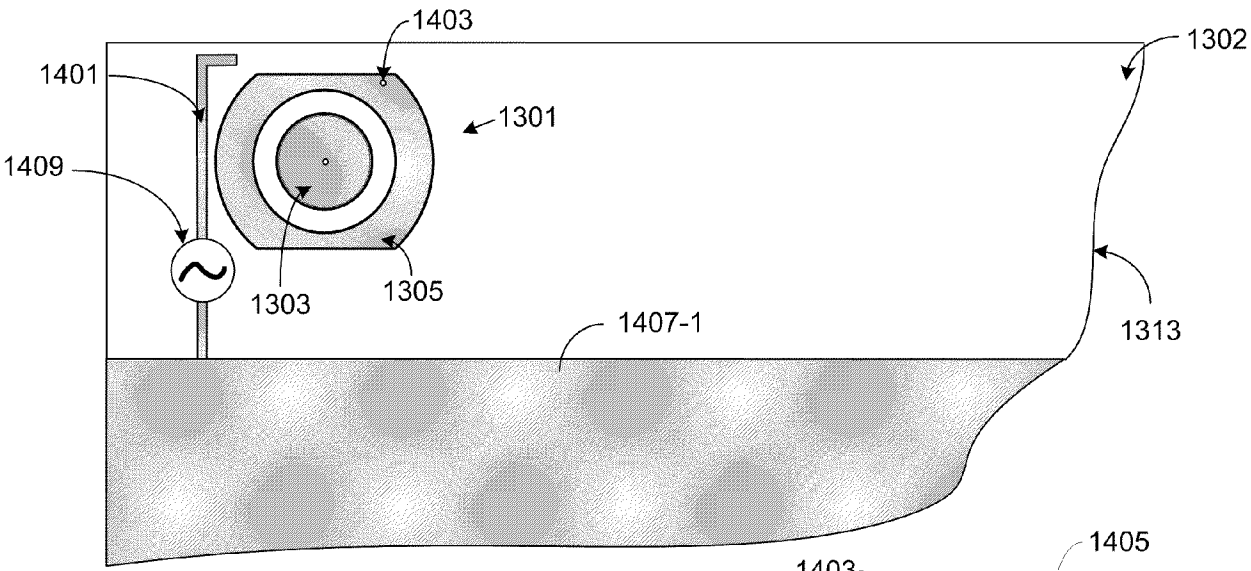
FIGS. 14A-14B illustrate a configuration of CRLH structures with peripheral structures to form a CRLH antenna device, according to an example embodiment.
Figure 14B:
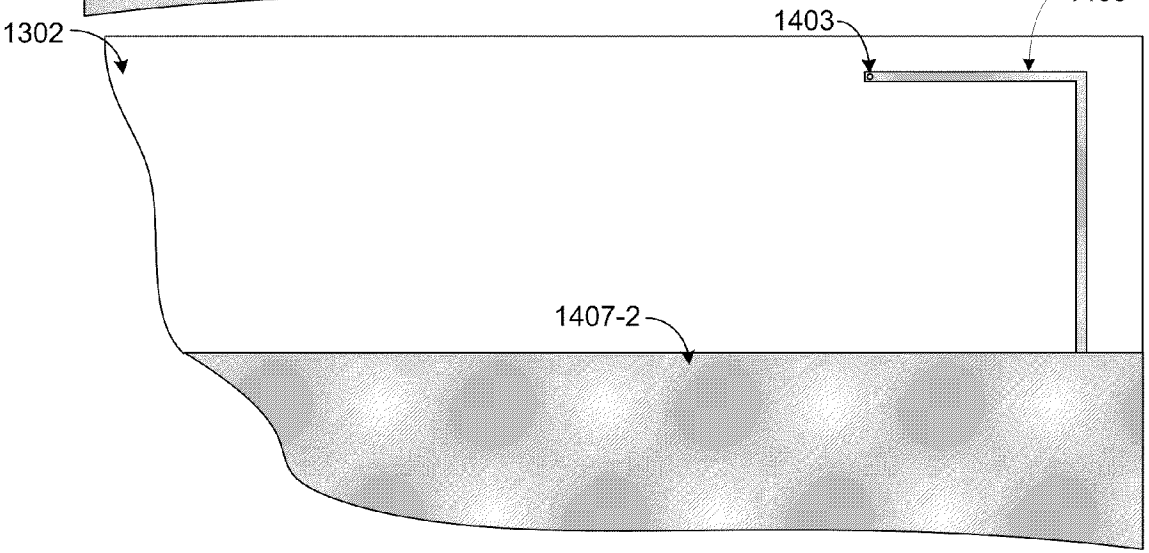

FIG. 13 presents one example of a keypad configuration among several other design possibilities. In most of these keypad designs, however, the operation and basic structure of the keypad typically remain the same. In one embodiment, one or more the key dome structures 1301 in FIG. 13 may be combined with other CRLH elements to form a CRLH antenna device as shown in FIG. 14. In FIG. 14A, for example, a CRLH antenna structure, formed in the antenna section 1313, may include a feed line 1401 coupled to the outer conductive ring 1305 of one of the existing key dome structures 1301. The feed line 1401 and outer conductive ring 1305 are formed on the top surface of the substrate 1302. A via 1403 is formed in the substrate 1302 and located near top edge portion of the outer conductive ring 1305. FIG. 14B illustrates a top view of the bottom surface of the substrate 1302. In FIG. 14B, the via 1403 is coupled to a bottom ground 1407-2 through a via line 1405. The size of the bottom ground 1407-2 may be extended by connecting it to a top ground 1407-1 through an array of vias (not shown).

An RF source 1409 may be applied to the feed line 1401 and top ground 1407-1 to operate the CRLH antenna device. In this example, the LH series capacitance CL may be generated by the capacitive coupling through the gap between the feed line 1401 and the outer conductive ring 1305. The RH series inductance LR may be generated in the feed line 1401 and the outer conductive ring 1305. The LH shunt inductance LL may be induced by the via 1403 and the via line 1405. The RH shunt capacitance CR may be induced between the outer conductive ring 1305 and a portion of the via line 1405. Notably, the outer conductive ring 1305 may operate as a member of the key dome structure for data input functionality and also as a cell patch, providing the LH and RH parameters for the CRLH antenna device. This dual-functionality design approach may offer antenna designs that have a smaller foot print area, reduced parts and materials, and lower fabrication costs.

FIGS. 14A-14B present one example of combining CRLH structures with peripheral structures to form a CRLH antenna device. This design may be beneficial in terms of reduced cost and PCB real estate. However, antenna performance, including return loss and efficiency, may be degraded by RF interference caused by the coupling between the CRLH antenna device and the key dome structures. Thus, isolating the key dome structures from the CRLH antenna may be needed to eliminate or minimize coupling effects and improve the performance of the antenna device.

Figure 15B:
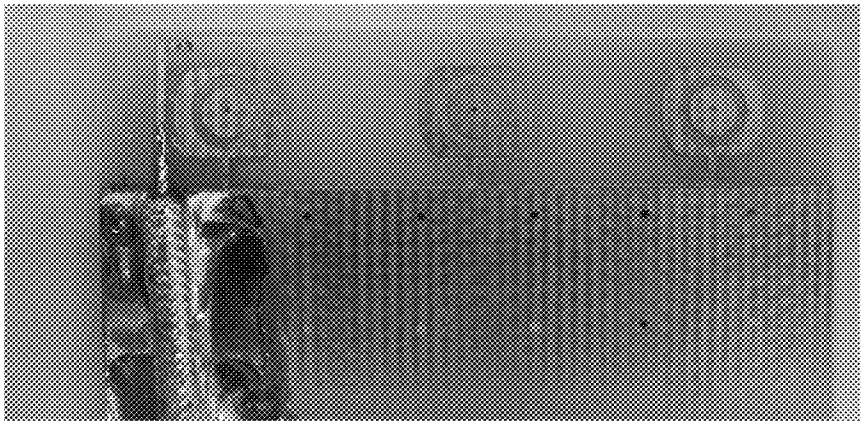
FIGS. 15A-15C illustrate various views of a fabricated model of a CRLH antenna device as in FIGS. 14A-14B, according to an example embodiment.
Figure 15C:
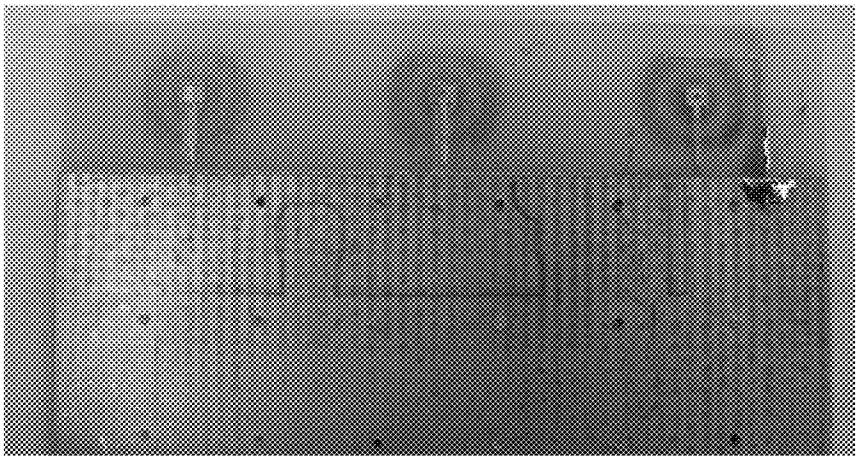
Figure 15A:
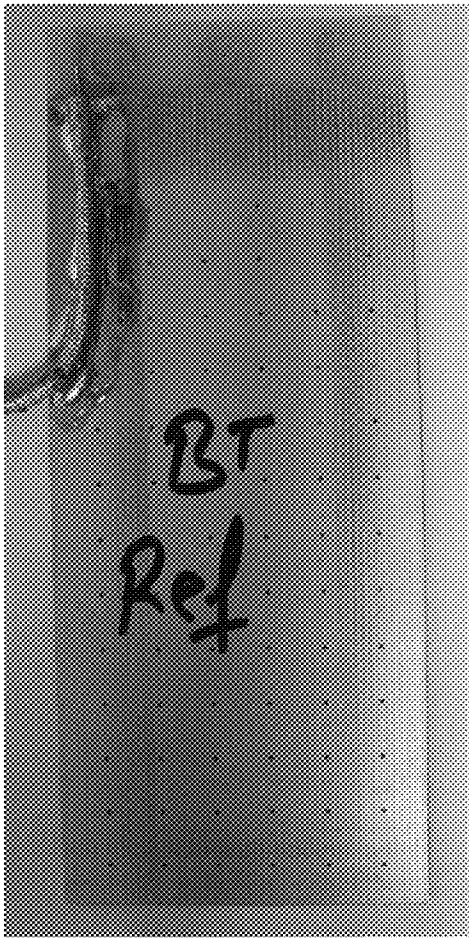

FIGS. 15A-15C illustrates various views of a fabricated model of the CRLH antenna device shown in FIGS. 14A-14B.

Figure 16A:
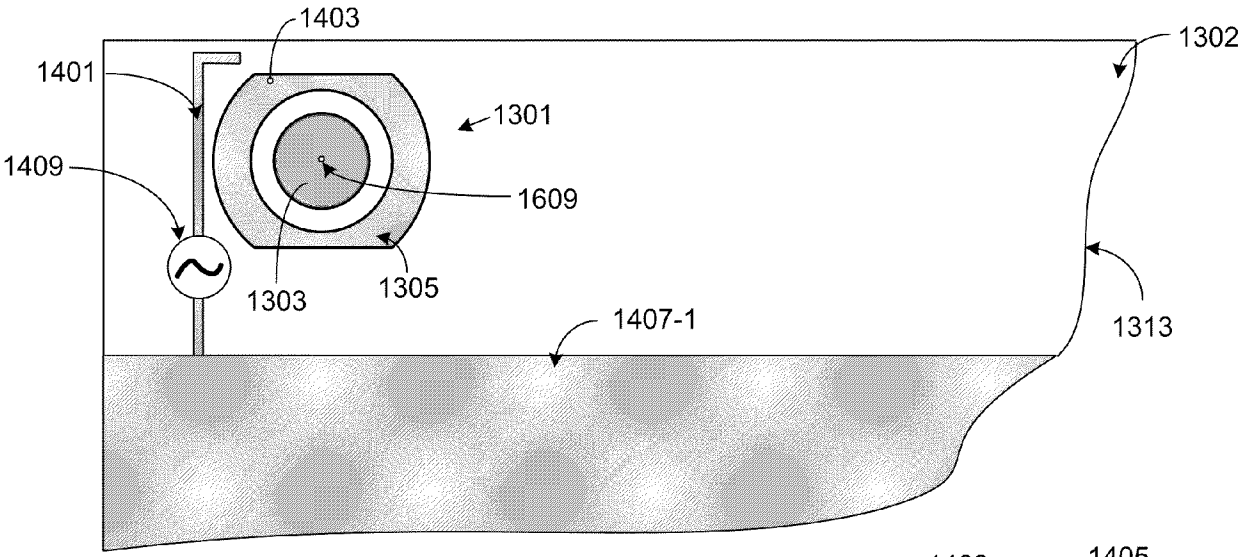
FIGS. 16A-16B illustrate a CRLH antenna device as in FIGS. 14A-14B with frequency-dependent isolation connectors, according to an example embodiment.
Figure 16B:
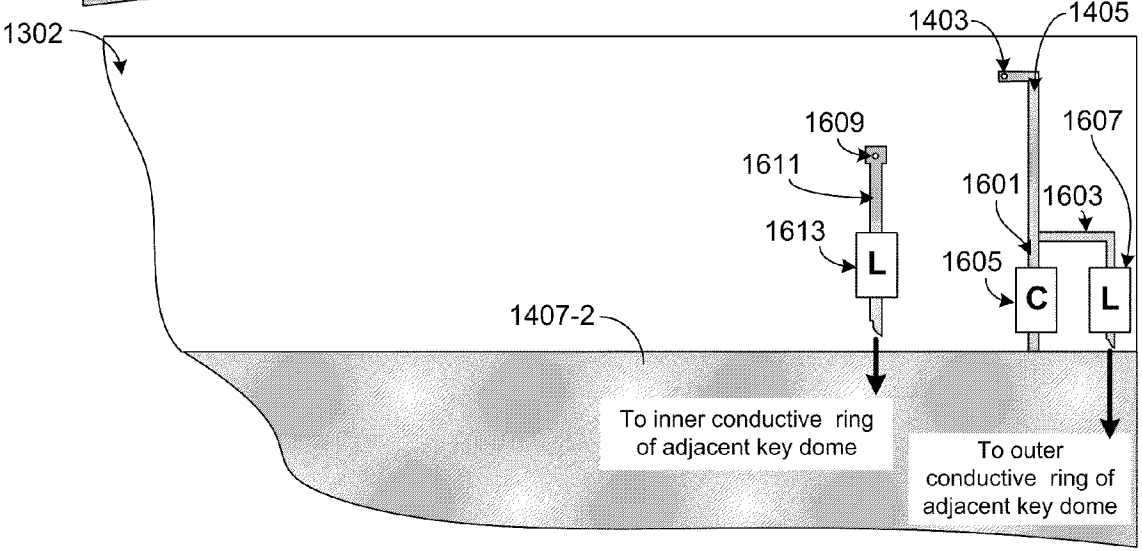

FIGS. 16A-16B illustrate an example of the CRLH antenna device shown in FIGS. 14A-14B with frequency-dependent connectors. These frequency-dependent connectors may provide adequate operation of the CRLH antenna structure and the keypad during RF and DC operation under certain conditions. Some frequency-dependent connectors include inductors and capacitors.

According to one embodiment, a CRLH antenna structure may include a feed line 1401 coupled to the outer conductive ring 1305 of one of the key dome structures 1301 as shown in FIG. 16A. The feed line 1401 and outer conductive ring 1305 are formed on the top surface of the substrate 1302. A via 1403 is formed in the substrate 1302 and located near a top edge portion of the outer conductive ring 1305.

FIG. 16B illustrates a top view of the bottom surface of the substrate 1302. In FIG. 16B, the via 1403 is coupled to a via line 1405 that divides into two separate branches 1601 and 1603. The first branch 1601 includes a capacitor 1605 that is coupled to the bottom ground 1407-2 while the second branch includes an inductor 1607 that may be coupled to the outer conductive ring of another key dome structure.

The key dome structure 1301 may also include a via 1609 formed in the substrate and located near the center of the inner conductive ring 1303 as shown in FIG. 16A. In FIG. 16B, for each key dome structure 1301, the via 1609 may be connected to a corresponding conductive line 1611 which is coupled to another inner conductive ring 1303 of an adjacent key dome structures 1301 through an inductor 1613.

The size of the bottom ground 1407-2 may be extended by connecting it to a top ground 1407-1 through an array of vias (not shown).

An RF source 1409 may be applied to the feed line 1401 and top ground 1407-1 to operate the CRLH antenna device. In operation, the LH series capacitance CL may be generated by the capacitive coupling through the gap between the feed line 1401 and the outer conductive ring 1305. The RH series inductance LR may be generated in the feed line 1401 and the outer conductive ring 1305. The LH shunt inductance LL may be induced by the via 1403 and the via line 1405. The RH shunt capacitance CR may be induced between the outer conductive ring 1305 and a portion of the via line 1405.

This embodiment takes into account a condition of having the key, associated with the CRLH antenna structure, in a released state (i.e., open switch). According to one embodiment, isolating the ground plane 1407 from the CRLH antenna device may be accomplished by the frequency-dependent connectors including the inductor 1613 located on each conductive line 1611, the capacitor 1605 attached to the first via line branch, and the inductor 1607 attached to the second via line branch. At low frequency operation, for example, each inductor 1607 and 1613 may act as a low impedance component which allows DC current to pass between the key dome structures 1301 in the keypad device. No current flows through the capacitor 1605 due to the high impedance the capacitor presents at the low frequency and thus prevents the CRLH antenna from operating. While operating at a high or microwave frequency, the inductor 1607 and 1613 may act as a high impedance component which can block current from flowing between the key dome structures 1301 in the keypad device and thus minimize or eliminate interference that may affect the CRLH antenna device during high frequency operation. Operation of the CRLH antenna device is maintained during high frequency operation since the capacitor 1605 provides the via line 1405 a path to the bottom ground plane 1407-2.

A number of design parameters and features of the CRLH antenna device illustrated in FIGS. 16A-16B can be used in designing the antenna for achieving certain antenna properties for specific applications. Some examples are provided below.

The substrate 1302 may measure, for example, and may include dielectric materials such as FR-4, FR-1, CEM-1 or CEM-3. These materials may have a dielectric constant measuring approximately 4.4, for example.

In FIGS. 16A-16B, each inductor may have an inductance measuring approximately 100 nH, and the capacitor may have a capacitance measuring approximately 27 pF.

Figure 17B:
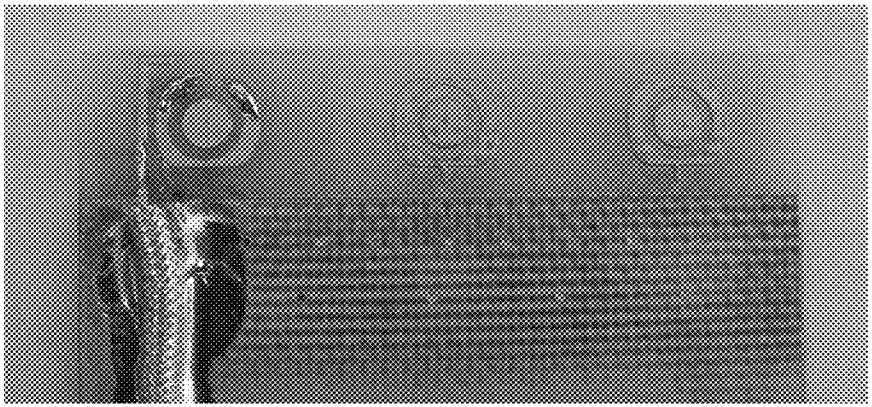
FIGS. 17A-17C illustrate various views of a fabricated model of the CRLH antenna device as in FIGS. 16A-16B, according to an example embodiment.
Figure 17C:
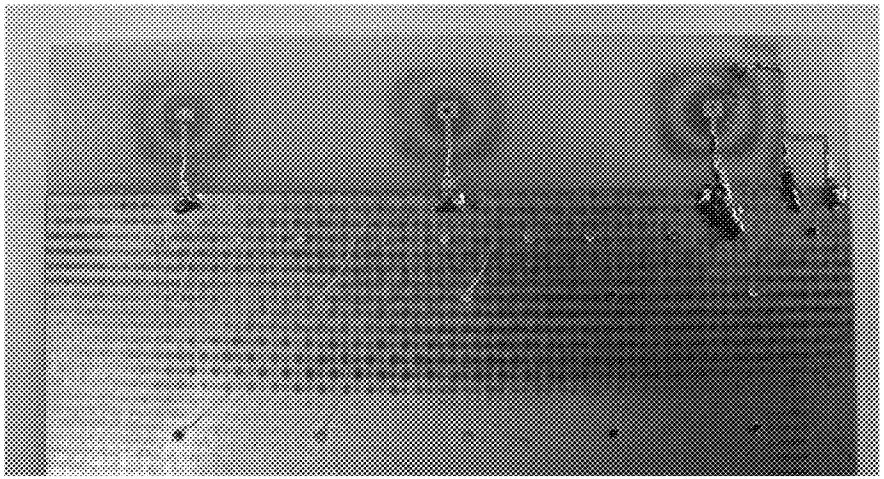
Figure 17A:
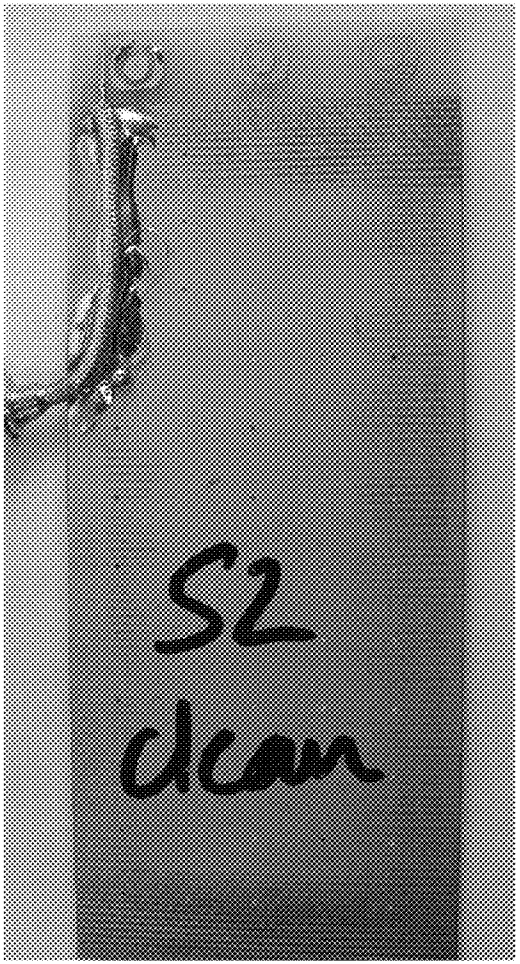

FIGS. 17A-17C illustrates various views of a fabricated model of the CRLH antenna device shown in FIGS. 16A-16B.

Figure 18:
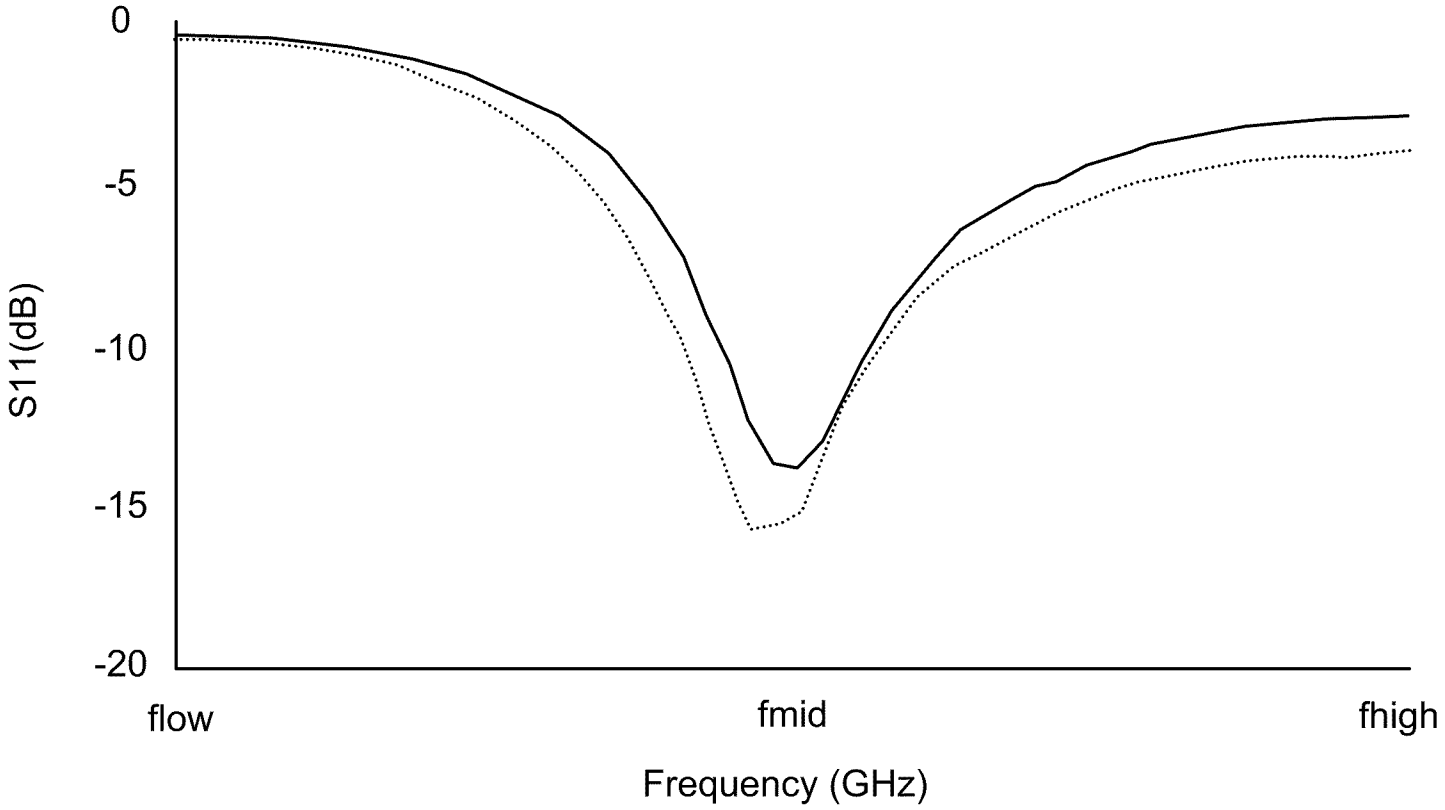
FIG. 18 illustrates a measured return loss plot of the CRLH antenna device without frequency-dependent connectors and CRLH antenna with frequency-dependent connectors, according to an example embodiment.

FIG. 18 illustrates a measured return loss plot of the CRLH antenna device without frequency-dependent connectors (dashed line) and multi-functional CRLH antenna device with frequency-dependent connectors (solid line). The measured return loss suggests the multi-functional CRLH antenna with the frequency-dependent connectors operates similar to the reference antenna (i.e., without connectors). This result is significant since it shows that the multi-functional CRLH antenna device operates well while the device is actively supporting keypad functions. Thus, RF interference produced during keypad operations, including the active DC current flow, is minimized in the multi-functional CRLH antenna device.

Figure 19:
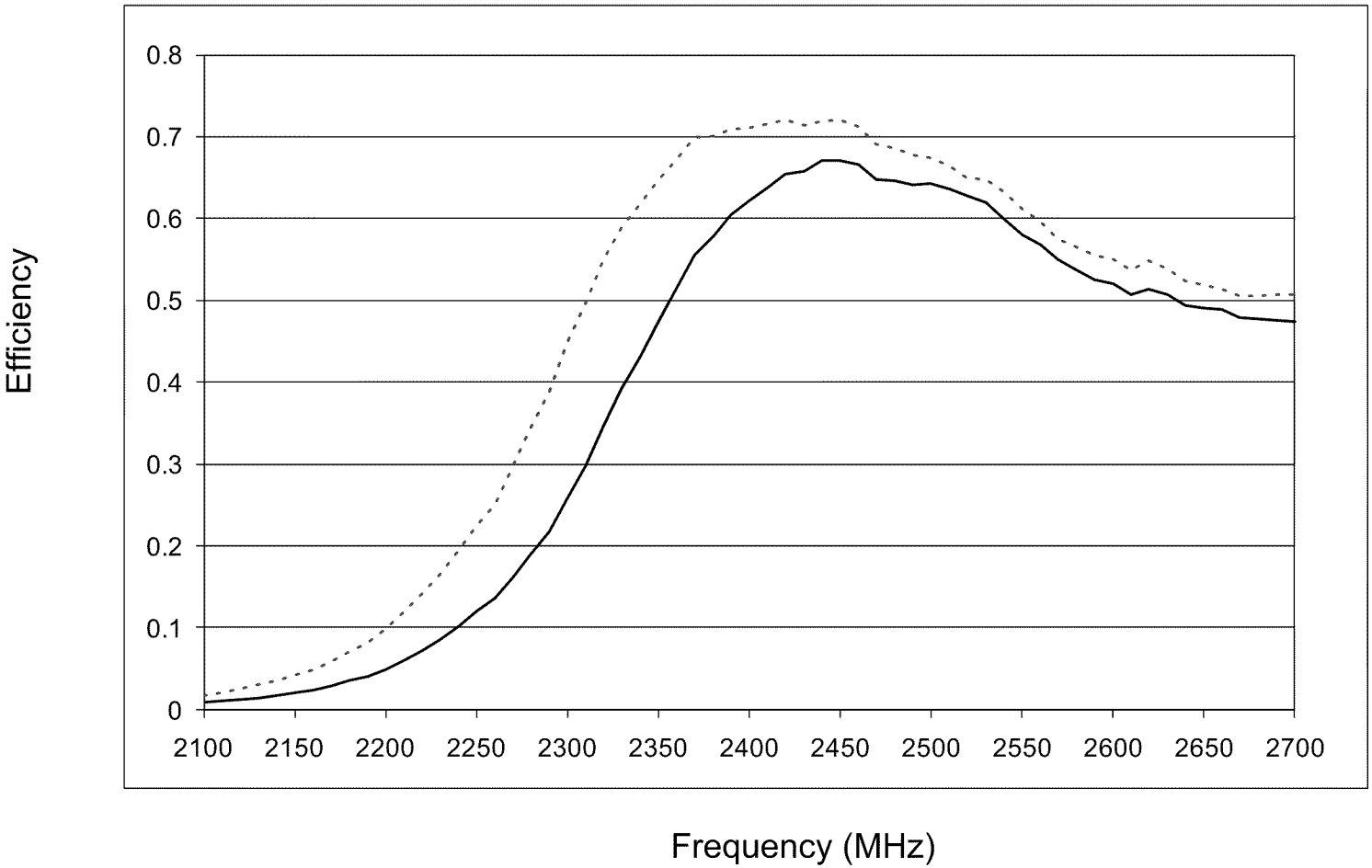
FIG. 19 illustrates a measured efficiency for the CRLH antenna device without frequency-dependent connectors and CRLH antenna with frequency-dependent connectors, according to an example embodiment.

FIG. 19 illustrates a measured efficiency for the CRLH antenna device without frequency-dependent connectors (dashed line) and multi-functional CRLH antenna with frequency-dependent connectors (solid line). This result indicates that the device may be capable of achieving an average efficiency, over a given range of frequency, which is equal or better than 65%. This result provides further support on the broad performance capability of the multi-functional CRLH antenna device while connected to other peripheral components.

Figure 20A:
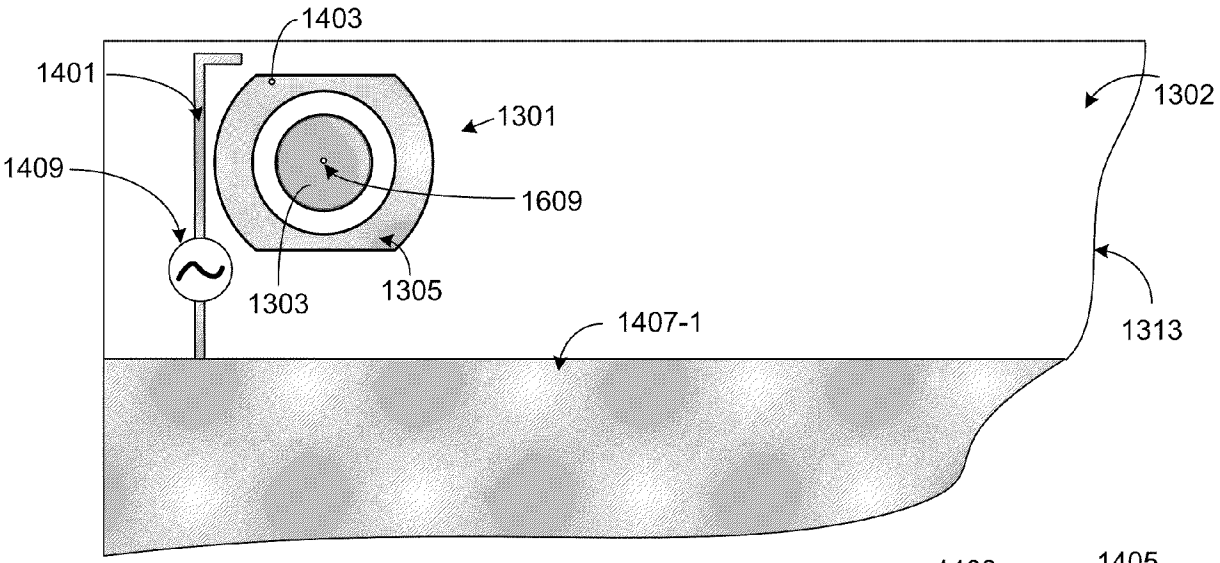
FIGS. 20A-20B illustrate modified implementation of the CRLH antenna device shown in FIGS. 16A-16B, according to an example embodiment.
Figure 20B:
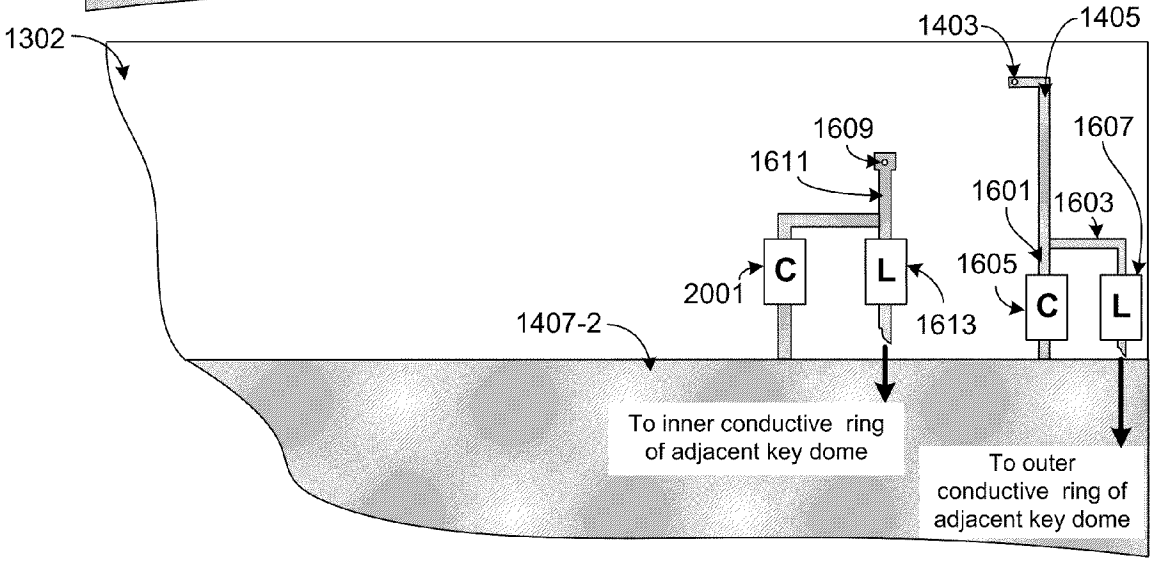

FIGS. 20A-20B illustrate an example of the CRLH antenna device shown in FIGS. 16A-16B with an additional capacitor connected to the conductive line 1611. This embodiment takes into account a condition of having the key, associated with the CRLH antenna structure, in a pressed state (i.e., closed switch). While this key is pressed, contact is made between the inner conductive ring 1303 and the outer conductive ring 1305, forming a larger conductive surface area. Since a portion of the CRLH antenna device includes the outer conductive ring 1305, pressing the key can influence the resonance frequency or bandwidth of the antenna. To minimize the effects of shifts in the resonance frequency or bandwidth of the antenna, a second capacitor 2001 is connected between the conductive line 1611 and the bottom ground 1407-2. Thus, operation of the CRLH antenna device is maintained during high frequency operation since the second capacitor 2001 may dominate the first capacitor 1605 and provides a shorter path to the bottom ground plane 1407-2.

Figure 21:
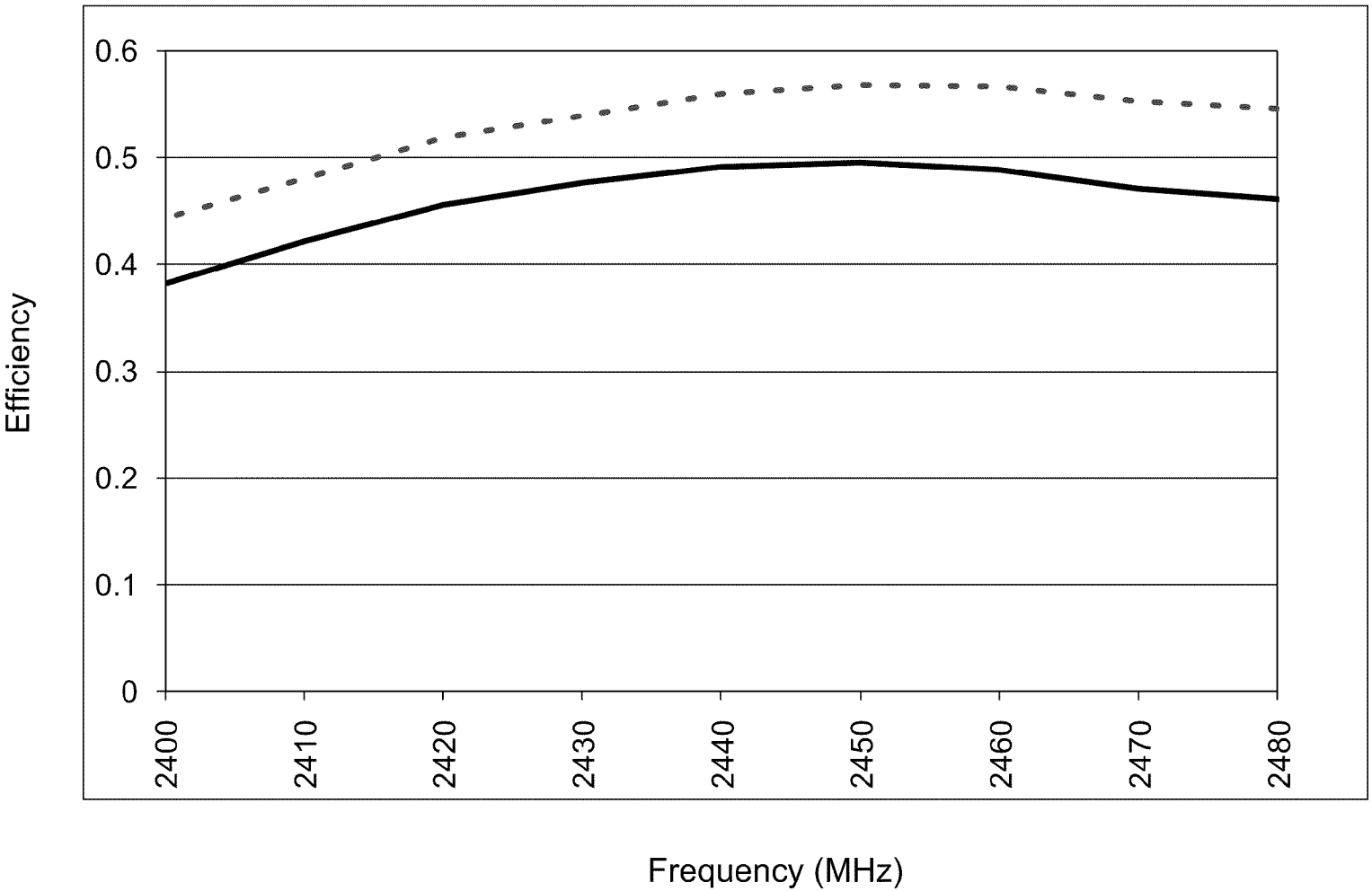
FIG. 21 illustrates a measured efficiency for the CRLH antenna device having an antenna key in a pressed state and CRLH antenna device having an antenna key in a released state, according to an example embodiment.

FIG. 21 illustrates a measured efficiency for the CRLH antenna device with the antenna key released (dashed line) and the CRLH antenna device with the antenna key pressed (solid line). This result indicates that the device may be capable of achieving an average efficiency, over a given range of frequency, which is equal or better than 50%. This result provides further support on the broad performance capabilities of the multi-functional CRLH antenna device while the antenna key is operating in a pressed or released state.

In another configuration, the size, shape, connection and location of the key dome structures may be modified to improve or enhance the CRLH antenna device performance. Also, multiple CRLH antenna devices, such as a CRLH WiFi antenna device and a secondary Bluetooth antenna device, may be formed using a various combination of available peripheral structures such as the multiple key dome structures. In addition, the multiple key dome structures may be combined and configured with other CRLH structures to form a dipole antenna or balanced CRLH antenna device.

In yet another configuration, the multiple key dome structures can be combined and configured with other CRLH structures to form an antenna with differential input. This differential antenna can be directly fed to a differential Low Noise Amplifier (LNA) eliminating the need for a balun, which in turn improve noise performance and reduces insertion loss.

Other types CRLH antenna devices may be formed using various peripheral components available on the PCB including, for example, a laptop keyboard, a built-in camera, a speaker, a microphone (with EMI considerations), and an LCD/LED.

The multi-functional CRLH antenna devices presented above may be configured to operate in various frequency bands including multiband, single-band, and low-band.

While this specification contains many specifics, these should not be construed as limitations on the scope of any invention or of what may be claimed, but rather as descriptions of features specific to particular embodiments. Certain features that are described in this specification in the context of separate embodiments may also be implemented in combination in a single embodiment. Conversely, various features that are described in the context of a single embodiment may also be implemented in multiple embodiments separately or in any suitable subcombination. Moreover, although features may be described above are acting in certain combinations and even initially claimed as such, one or more features from a claimed combination may in some cases be exercised from the combination, and the claimed combination may be directed to a subcombination or variation of a subcombination.

Thus, particular embodiments have been described. Variations, enhancements and other embodiments may be made based on what is described and illustrated.

What is claimed is:

1. A metamaterial antenna device comprising:

a substrate structure;

one or more metallization layers supported by the substrate structure and structured to include:

a cell patch comprising a first switch contact;

a second switch contact configured to be bridged to the first switch contact when a switch is actuated;

a first ground electrode formed in one of the one or more metallization layers and conductively coupled to the cell patch through a conductive path; and a feed structure coupled to the cell patch;

wherein the cell patch, the feed structure, and at least part of the substrate structure are configured to form a Composite Right/Left Handed (CRLH) antenna device structured to provide multiple resonant operating frequencies; and wherein one or more of the first switch contact or the second switch contact is coupled to the first ground electrode using a frequency-selective coupling configured to suppress a shift in the multiple resonant operating frequencies between a state when the first and second switch contacts are isolated from each other as compared to a state where the first and second switch contacts are bridged.

2. The metamaterial antenna device as in claim 1, wherein the cell patch is capacitively coupled to the feed structure.

3. The metamaterial antenna device as in claim 2, wherein the capacitive coupling between the feed structure and the cell patch forms a Left Hand (LH) capacitance.

4. The metamaterial antenna device as in claim 3, wherein the conductive path is structured to provide an inductive load to the cell patch, wherein the inductive load forms a Right Hand (RH) inductance.

5. The metamaterial antenna device as in claim 4, wherein the RH inductance is structured to induce a RH resonant frequency, and the LH capacitance is structured to induce a LH resonant frequency lower than the RH resonant frequency.

6. The device as in claim 5, wherein a RH capacitance is formed between the cell patch and the first ground electrode, wherein the cell patch is positioned so as to reduce the RH capacitance.

7. A method, comprising:

providing a substrate structure including one or more metallization layers;

forming a cell patch comprising a first switch contact on one of the one or more metallization layers;

forming a second switch contact on one of the one or more metallization layers, the second switch contact configured to be bridged to the first switch contact when a switch is actuated;

forming a first ground electrode on one of the one or more metallization layers, the first ground electrode conductively coupled to the cell patch through a conductive path; and forming a feed structure on one of the one or more metallization layers, the feed structure coupled to the cell patch;

wherein the cell patch, the feed structure, and at least part of the substrate structure form a Composite Right/Left Handed (CRLH) antenna device structured to provide multiple resonant operating frequencies; and wherein one or more of the first switch contact or the second switch contact is coupled to the first ground electrode using a frequency-selective coupling configured to suppress a shift in the multiple resonant operating frequencies between a state when the first and second switch contacts are isolated from each other as compared to a state where the first and second switch contacts are bridged.

8. The method as in claim 7, wherein the cell patch is capacitively coupled to the feed structure.

9. The metamaterial antenna device of claim 2, wherein the feed structure and the cell patch are located on the same metallization layer of the substrate structure.

10. The metamaterial antenna device of claim 1, wherein the cell patch is located on a first metallization layer of the substrate structure; and wherein the first ground electrode is located on a second metallization layer of the substrate structure.

11. The metamaterial antenna device of claim 10, wherein the first ground electrode is located outside of a footprint of the cell patch projected from the first metallization layer of the substrate structure to the second metallization layer of the substrate structure.

12. The metamaterial antenna device of claim 10, comprising a second ground electrode located on the first metallization layer of the substrate structure.

13. The metamaterial antenna device of claim 1, wherein the first switch contact comprises an outer conductive ring;

wherein the second switch contact comprises an inner electrode located on the same metallization layer as the outer conductive ring; and wherein the second switch contact is located within an enclosed region formed by the outer conductive ring of the first switch contact.

14. The metamaterial antenna device of claim 1, comprising one or more of an inductor or a capacitor coupled between the first switch contact and another switch contact, the one or more of the inductor or the capacitor configured to suppress conductive coupling of a communication signal between the cell patch comprising the first switch contact and another switch contact.

15. The method of claim 7, wherein the cell patch is located on a first metallization layer of the substrate structure;

wherein the first ground electrode is located on a second metallization layer of the substrate structure; and wherein the first ground electrode is located outside of a footprint of the cell patch projected from the first metallization layer of the substrate structure to the second metallization layer of the substrate structure.

16. The metamaterial antenna device of claim 1, wherein the cell patch comprising the first switch contact is coupled to the first ground electrode using a frequency-selective coupling including an inductor and a capacitor.

17. The metamaterial antenna device of claim 16, wherein one or more of the inductor or the capacitor includes a lumped component.

18. The metamaterial antenna device of claim 1, wherein the second switch contact is coupled to the first ground electrode using a frequency selective coupling including an inductor and a capacitor.

19. The metamaterial antenna device of claim 18, wherein one or more of the inductor or the capacitor includes a lumped component.

20. The method of claim 7, wherein the cell patch comprising the first switch contact is coupled to the first ground electrode using a frequency-selective coupling including an inductor and a capacitor.

21. The method of claim 7, if wherein the second switch contact is coupled to the first ground electrode using a frequency selective coupling including an inductor and a capacitor.

* * * * *

UNITED STATES PATENT AND TRADEMARK OFFICE

CERTIFICATE OF CORRECTION

PATENT NO. : 8,803,739 B2
APPLICATION NO. : 13/038450
DATED : August 12, 2014
INVENTOR(S) : Rajgopal et al.

It is certified that error appears in the above-identified patent and that said Letters Patent is hereby corrected as shown below:

In the Claims

In column 20, line 53, in Claim 21, before “wherein”, delete “if”, therefor

Signed and Sealed this
Second Day of December, 2014

Michelle K. Lee

Michelle K. Lee
*Deputy Director of the United States Patent and Trademark Office*